US006705565B1

(12) United States Patent
Newman et al.

(10) Patent No.: US 6,705,565 B1
(45) Date of Patent: Mar. 16, 2004

(54) SYSTEM AND DISPENSER FOR DISPENSING WET WIPES

(75) Inventors: William R. Newman, Neenah, WI (US); Herb F. Velazquez, Neenah, WI (US); Ligia A. Rivera, Appleton, WI (US); Cherry A. Bochmann, Cleveland, OH (US); Michael J. Faulks, Neenah, WI (US); Yung H. Huang, Appleton, WI (US); Paige A. Dellerman, Appleton, WI (US); John E. Peluso, Appleton, WI (US); Steve J. Romme, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/565,227

(22) Filed: May 4, 2000

Related U.S. Application Data

(63) Continuation-in-part of application No. 09/545,995, filed on Apr. 10, 2000.
(60) Provisional application No. 60/132,024, filed on Apr. 30, 1999.

(51) Int. Cl.[7] ..... B65H 16/06; B65H 18/04
(52) U.S. Cl. ..... 242/598.6
(58) Field of Search ..... 242/598.6, 598, 242/598.3, 598.5, 596.8

(56) References Cited

U.S. PATENT DOCUMENTS 1,664,392 A 4/1928 Baruch (List continued on next page.)

FOREIGN PATENT DOCUMENTS

| | | |
|---|---|---|
| EP | 0 122 809 A1 | 10/1984 |
| EP | 0 343 304 A2 | 11/1989 |
| EP | 0 501 905 A1 | 9/1992 |
| EP | 0 608 460 A1 | 8/1994 |
| EP | 0 728 426 A1 | 8/1996 |
| EP | 0 608 460 B1 | 9/1998 |
| EP | 1 002 746 A1 | 5/2000 |
| EP | 1 023 863 A1 | 8/2000 |
| GB | 990332 | 4/1965 |
| GB | 1324818 | 7/1973 |
| WO | WO 93/17933 | 9/1993 |
| WO | WO 96/21388 A1 | 7/1996 |
| WO | WO 98/08763 A1 | 3/1998 |
| WO | WO 98/34781 | 8/1998 |
| WO | WO 99/06311 A2 | 2/1999 |
| WO | WO 99/01536 A1 | 4/1999 |
| WO | WO 00/00071 | 1/2000 |
| WO | WO 00/08998 | 2/2000 |
| WO | WO 00/57843 | 10/2000 |
| WO | WO 01/17496 | 3/2001 |
| WO | WO 01/41613 A1 | 6/2001 |

OTHER PUBLICATIONS

Images of Fresh & Clean product—wet toilet paper; approximately Sep. 2000; 3 pages plus attached translation.
Search Report for Patent Cooperation Treaty application No. PCT/US 01/11195, Date of Mailing Jul. 19, 2001, 7 pages.

(List continued on next page.)

*Primary Examiner*—Emmanuel Marcelo
(74) *Attorney, Agent, or Firm*—Brinks Hofer Gilson & Lione

(57) ABSTRACT

There is provided a system and apparatus for dispensing wet wipes. The system may include a housing, a tray and a cartridge. The cartridge has the ability to be inserted into the dispenser in a pre-selected manner based on the desired orientation of the wipes contained therein.

7 Claims, 24 Drawing Sheets

U.S. PATENT DOCUMENTS

| | | | | | |
|---|---|---|---|---|---|
| 2,440,974 | A | | 5/1948 | Resch | |
| 2,487,763 | A | * | 11/1949 | Patterson et al. | 242/598.6 |
| 3,291,411 | A | * | 12/1966 | Krueger et al. | 242/298.6 |
| 3,310,353 | A | | 3/1967 | Cordis | |
| 3,368,522 | A | | 2/1968 | Cordis | |
| 3,532,210 | A | | 10/1970 | Minion et al. | |
| 3,568,635 | A | | 3/1971 | Poitras et al. | |
| 3,592,161 | A | | 7/1971 | Hoffmann | |
| 3,603,519 | A | | 9/1971 | Brown | |
| 3,633,838 | A | | 1/1972 | Krueger | |
| 3,656,699 | A | | 4/1972 | Schnyder et al. | |
| 3,713,170 | A | | 1/1973 | Kaufman | |
| 3,729,145 | A | | 4/1973 | Koo et al. | |
| 3,754,804 | A | | 8/1973 | Cushman | |
| 3,756,483 | A | | 9/1973 | Schraeder | |
| 3,771,399 | A | | 11/1973 | Aterianus | |
| 3,771,739 | A | | 11/1973 | Nelson | |
| 3,775,801 | A | | 12/1973 | Walker | |
| 3,780,908 | A | | 12/1973 | Fitzpatrick et al. | |
| 3,784,055 | A | | 1/1974 | Anderson | |
| 3,788,573 | A | | 1/1974 | Thomson et al. | |
| 3,795,355 | A | | 3/1974 | Gerstein | |
| 3,806,055 | A | | 4/1974 | Bauman | |
| 3,824,953 | A | | 7/1974 | Boone | |
| 3,836,044 | A | | 9/1974 | Tilp et al. | |
| 3,836,045 | A | | 9/1974 | Duhy et al. | |
| 3,837,595 | A | | 9/1974 | Boone | |
| 3,841,466 | A | | 10/1974 | Hoffman et al. | |
| 3,843,017 | A | | 10/1974 | Harrison | |
| 3,848,822 | A | | 11/1974 | Boone | |
| 3,865,271 | A | | 2/1975 | Gold | |
| 3,868,052 | A | | 2/1975 | Rockerfeller | |
| 3,890,622 | A | | 6/1975 | Alden | |
| 3,913,522 | A | | 10/1975 | Light | |
| 3,943,859 | A | | 3/1976 | Boone | |
| 3,949,947 | A | | 4/1976 | Youngquist et al. | |
| 3,967,756 | A | | 7/1976 | Barish | |
| 3,970,215 | A | | 7/1976 | McLaren et al. | |
| 3,973,695 | A | | 8/1976 | Ames | |
| 3,982,659 | A | | 9/1976 | Ross | |
| 3,986,479 | A | | 10/1976 | Bonk | |
| 3,994,417 | A | | 11/1976 | Boedecker | |
| 3,995,582 | A | | 12/1976 | Douglas | |
| 4,002,264 | A | | 1/1977 | Marchesani | |
| 4,004,687 | A | | 1/1977 | Boone | |
| 4,025,004 | A | | 5/1977 | Massey | |
| 4,043,519 | A | | 8/1977 | Suzuki et al. | |
| 4,069,789 | A | | 1/1978 | Fukagawa et al. | |
| 4,071,200 | A | | 1/1978 | Stone | |
| 4,098,469 | A | | 7/1978 | McCarthy | |
| 4,101,026 | A | | 7/1978 | Bonk | |
| 4,106,433 | A | | 8/1978 | Fernando et al. | |
| 4,106,616 | A | | 8/1978 | Boone | |
| 4,106,617 | A | | 8/1978 | Boone | |
| 4,114,824 | A | | 9/1978 | Danielak | |
| 4,124,259 | A | | 11/1978 | Harris | |
| 4,131,195 | A | | 12/1978 | Worrell, Sr. | |
| 4,135,199 | A | | 1/1979 | Kurland et al. | |
| 4,135,678 | A | | 1/1979 | Williams | |
| 4,138,034 | A | | 2/1979 | McCarthy | |
| 4,179,078 | A | | 12/1979 | Mansfield | |
| 4,191,317 | A | | 3/1980 | Harkins | |
| 4,205,802 | A | | 6/1980 | Economakis | |
| 4,219,129 | A | | 8/1980 | Sedwick | |
| 4,222,621 | A | | 9/1980 | Greenlee et al. | |
| 4,235,333 | A | | 11/1980 | Boone | |
| 4,238,541 | A | | 12/1980 | Burton | |
| 4,244,493 | A | | 1/1981 | Harrison | |
| 4,260,117 | A | | 4/1981 | Perrin et al. | |
| 4,272,473 | A | | 6/1981 | Riemersma et al. | |
| 4,274,573 | A | | 6/1981 | Finkelstein | |
| 4,280,978 | A | | 7/1981 | Dannheim et al. | |
| 4,294,389 | A | | 10/1981 | Falk et al. | |
| 4,328,907 | A | | 5/1982 | Beard | |
| 4,353,480 | A | | 10/1982 | McFadyen | |
| 4,363,454 | A | | 12/1982 | Mohar | |
| 4,375,874 | A | | 3/1983 | Leotta et al. | |
| 4,383,656 | A | | 5/1983 | Campbell | |
| 4,401,248 | A | | 8/1983 | Helms | |
| 4,411,374 | A | | 10/1983 | Hotchkiss | |
| 4,425,012 | A | | 1/1984 | Kley | |
| 4,427,159 | A | | 1/1984 | Miller et al. | |
| 4,428,497 | A | | 1/1984 | Julius et al. | |
| 4,432,504 | A | | 2/1984 | Pace | |
| 4,436,221 | A | | 3/1984 | Margulies | |
| 4,447,015 | A | | 5/1984 | Peterson | |
| 4,453,634 | A | | 6/1984 | Blumenthal | |
| 4,463,912 | A | | 8/1984 | Grunerud | |
| 4,467,974 | A | | 8/1984 | Crim | |
| 4,526,291 | A | | 7/1985 | Margulies | |
| 4,535,912 | A | | 8/1985 | Bonk | |
| 4,550,855 | A | | 11/1985 | Harrison | |
| 4,564,148 | A | | 1/1986 | Wentworth | |
| 4,566,606 | A | | 1/1986 | Kling | |
| 4,570,820 | A | | 2/1986 | Murphy | |
| 4,601,938 | A | | 7/1986 | Deacon et al. | |
| 4,607,809 | A | | 8/1986 | Sineni et al. | |
| 4,648,530 | A | | 3/1987 | Granger | |
| 4,659,028 | A | | 4/1987 | Wren | |
| 4,662,576 | A | | 5/1987 | Paul | |
| 4,662,577 | A | | 5/1987 | Lewis | |
| 4,667,890 | A | | 5/1987 | Gietman, Jr. | |
| 4,684,075 | A | | 8/1987 | Francis | |
| 4,687,153 | A | | 8/1987 | McNeil | |
| 4,690,345 | A | | 9/1987 | Cotey | |
| 4,721,264 | A | | 1/1988 | Muscarello | |
| 4,735,317 | A | | 4/1988 | Sussman et al. | |
| 4,756,485 | A | | 7/1988 | Bastian et al. | |
| 4,784,290 | A | | 11/1988 | Howard | |
| 4,790,490 | A | | 12/1988 | Chakravorty | |
| 4,807,823 | A | | 2/1989 | Wyant | |
| 4,826,063 | A | | 5/1989 | Ban | |
| 4,828,193 | A | | 5/1989 | Galbraith | |
| 4,830,301 | A | | 5/1989 | Miller | |
| 4,834,316 | A | * | 5/1989 | DeLorean | 242/596.8 |
| 4,836,368 | A | | 6/1989 | Cotton | |
| 4,836,462 | A | | 6/1989 | Bruss | |
| 4,846,412 | A | | 7/1989 | Morand | |
| 4,860,893 | A | | 8/1989 | Kaufman | |
| D303,890 | S | | 10/1989 | Pilot | |
| 4,877,133 | A | | 10/1989 | Klenter et al. | |
| 4,883,197 | A | | 11/1989 | Sanchez et al. | |
| 4,884,690 | A | | 12/1989 | Klenter et al. | |
| 4,889,292 | A | * | 12/1989 | Lowe et al. | 242/596.8 |
| 4,890,205 | A | | 12/1989 | Shaffer | |
| 4,913,365 | A | | 4/1990 | Shamass | |
| 4,936,452 | A | | 6/1990 | Pauley | |
| 4,940,626 | A | | 7/1990 | Rhodes, III et al. | |
| D311,106 | S | | 10/1990 | Jaber | |
| 4,978,095 | A | | 12/1990 | Phillips | |
| 4,984,530 | A | | 1/1991 | Dutton | |
| 4,989,800 | A | | 2/1991 | Tritch | |
| 4,991,538 | A | | 2/1991 | Davids et al. | |
| 5,000,393 | A | | 3/1991 | Madsen | |
| 5,001,956 | A | | 3/1991 | Nitsch | |
| 5,009,313 | A | | 4/1991 | Morand | |
| 5,012,986 | A | | 5/1991 | Needle | |
| 5,029,787 | A | | 7/1991 | Florentin | |
| 5,049,440 | A | | 9/1991 | Bornhoeft, III et al. | |
| 5,050,737 | A | | 9/1991 | Joslyn et al. | |
| 5,070,171 | A | | 12/1991 | O'Lenick, Jr. | |

5,104,054 A 4/1992 Latham
5,114,771 A 5/1992 Ogg et al.
5,137,173 A 8/1992 Hughes et al.
5,141,171 A 8/1992 Yang
5,145,091 A 9/1992 Meyers
5,149,765 A 9/1992 O'Lenick, Jr.
D329,978 S 10/1992 Ryan
5,154,496 A 10/1992 Campbell et al.
5,170,958 A 12/1992 Brown
5,172,840 A 12/1992 Bloch et al.
5,192,044 A 3/1993 Baskin
5,193,759 A 3/1993 Bigelow et al.
5,195,689 A 3/1993 Beer et al.
5,207,367 A 5/1993 Dunn et al.
5,219,092 A 6/1993 Morand
5,228,632 A 7/1993 Addison et al.
5,235,017 A 8/1993 O'Lenick, Jr.
5,237,035 A 8/1993 O'Lenick, Jr. et al.
5,253,818 A 10/1993 Craddock
5,255,800 A 10/1993 Kelly
5,260,401 A 11/1993 O'Lenick, Jr.
D342,635 S 12/1993 Carter et al.
D342,852 S 1/1994 Welch
5,277,375 A 1/1994 Dearwester
5,310,262 A 5/1994 Robison et al.
5,311,986 A 5/1994 Putz
5,312,883 A 5/1994 Komatsu et al.
5,317,063 A 5/1994 Komatsu et al.
D347,534 S 6/1994 Gottselig
5,335,811 A 8/1994 Morand
5,368,157 A 11/1994 Gasparrini et al.
5,370,336 A 12/1994 Whittington
5,374,008 A 12/1994 Halvorson et al.
5,384,189 A 1/1995 Kuroda et al.
5,392,945 A 2/1995 Syrek
5,400,982 A 3/1995 Collins
5,409,181 A 4/1995 Patrick
5,411,729 A 5/1995 O'Lenick, Jr.
5,439,521 A * 8/1995 Rao ..... 242/598.6
5,443,084 A 8/1995 Saleur
5,449,127 A 9/1995 Davis
D362,773 S 10/1995 Kartchner
5,456,420 A 10/1995 Frazier
5,456,421 A 10/1995 Reed
5,462,197 A 10/1995 Pound
5,464,096 A 11/1995 Hurwitz
5,464,170 A 11/1995 Mitchell et al.
5,480,060 A 1/1996 Blythe
5,494,250 A 2/1996 Chen
5,495,997 A 3/1996 Moody
5,501,323 A 3/1996 Denesha et al.
5,509,593 A 4/1996 Bloch et al.
5,520,308 A 5/1996 Berg, Jr. et al.
5,526,973 A 6/1996 Boone et al.
5,533,621 A 7/1996 Schoal, Jr.
5,540,332 A 7/1996 Kopacz et al.
5,542,568 A 8/1996 Julius
5,560,514 A 10/1996 Frazier
5,562,964 A 10/1996 Jones
5,588,615 A 12/1996 Batts
D377,284 S 1/1997 Farrow et al.
5,598,987 A 2/1997 Wachowicz
5,604,992 A 2/1997 Robinson
5,605,250 A 2/1997 Meiron et al.
5,609,269 A 3/1997 Behnke et al.
5,618,008 A 4/1997 Dearwester et al.
5,620,148 A 4/1997 Mitchell
5,624,025 A 4/1997 Hixon
5,630,526 A 5/1997 Moody
5,630,563 A 5/1997 Meisner et al.
5,631,317 A 5/1997 Komatsu et al.
5,642,810 A 7/1997 Warner et al.
5,649,676 A 7/1997 Lord
D381,851 S 8/1997 Sharpe
5,653,403 A 8/1997 Ritchey
5,655,661 A 8/1997 Rigby
5,660,313 A * 8/1997 Newbold ..... 242/298.6
5,660,636 A 8/1997 Shangold et al.
5,667,092 A 9/1997 Julius et al.
5,669,576 A 9/1997 Moody
5,672,206 A 9/1997 Gorman
D386,025 S 11/1997 Mervar et al.
5,687,875 A 11/1997 Watts et al.
D387,590 S 12/1997 Cameron et al.
5,697,576 A 12/1997 Bloch et al.
5,697,577 A * 12/1997 Ogden ..... 242/598.6
5,704,565 A 1/1998 Cheng
5,704,566 A 1/1998 Schutz et al.
5,727,458 A 3/1998 Schulz
5,755,654 A 5/1998 Schultz et al.
5,765,717 A 6/1998 Gottselig
D397,265 S 8/1998 Badillo
5,839,688 A 11/1998 Hertel et al.
RE35,976 E 12/1998 Gasparrini et al.
5,848,762 A 12/1998 Reinheimer et al.
5,868,275 A 2/1999 Moody
5,868,335 A 2/1999 Lebrun
5,868,344 A 2/1999 Melnick
5,868,345 A 2/1999 Beisser
5,868,346 A 2/1999 Cobos
5,868,347 A 2/1999 Paul et al.
5,875,985 A 3/1999 Cohen et al.
5,887,759 A 3/1999 Ayigbe
5,887,818 A 3/1999 Kelley
5,893,531 A 4/1999 Taylor et al.
5,897,074 A 4/1999 Marino
5,901,921 A 5/1999 Perlsweig
5,904,316 A 5/1999 Dunning et al.
5,914,177 A 6/1999 Smith, III et al.
5,924,617 A 7/1999 LaCount et al.
D412,439 S 8/1999 Cormack
5,938,013 A 8/1999 Palumbo et al.
5,950,960 A 9/1999 Marino
5,951,762 A 9/1999 Shangold et al.
5,958,187 A 9/1999 Bhat et al.
5,964,351 A 10/1999 Zander
5,967,452 A 10/1999 Wilder
5,971,138 A 10/1999 Soughan
5,971,142 A 10/1999 Jones
D416,794 S 11/1999 Cormack
D417,109 S 11/1999 Johnson et al.
5,979,821 A 11/1999 LaCount et al.
5,992,718 A 11/1999 Zaranck
D417,987 S 12/1999 Velazquez
6,000,538 A 12/1999 Lee
6,000,658 A 12/1999 McCall, Jr.
6,007,019 A 12/1999 Lynch
6,010,001 A 1/2000 Osborn, III
6,015,125 A 1/2000 Fischer
6,024,216 A 2/2000 Shillington et al.
6,024,217 A 2/2000 Ponsi et al.
6,024,323 A 2/2000 Palerno, Jr.
6,029,921 A 2/2000 Johnson
D421,691 S 3/2000 Hoblitz
6,036,134 A 3/2000 Moody
D422,437 S 4/2000 Conran et al.
6,047,920 A 4/2000 Dearwester et al.
6,056,233 A 5/2000 Von Schenk
6,056,235 A 5/2000 Brozinsky
6,059,882 A 5/2000 Steinhardt et al.
6,059,928 A 5/2000 Van Luu et al.
6,068,118 A 5/2000 Calloway

| | | | | |
|---|---|---|---|---|
| 6,070,821 | A | 6/2000 | Mitchell | |
| 6,079,603 | A | 6/2000 | Smegal | |
| 6,082,664 | A | 7/2000 | Phelps et al. | |
| 6,085,899 | A | 7/2000 | Thorsbakken | |
| 6,092,690 | A | 7/2000 | Bitowft et al. | |
| 6,092,758 | A | 7/2000 | Gemmell | |
| 6,092,759 | A | 7/2000 | Gemmell et al. | |
| D429,282 | S | 8/2000 | Valazquez et al. | |
| 6,098,836 | A | 8/2000 | Gottselig | |
| 6,121,165 | A | 9/2000 | Mackey et al. | |
| 6,138,939 | A | 10/2000 | Phelps et al. | |
| 6,158,614 | A | 12/2000 | Haines et al. | |
| 6,228,454 | B1 | 5/2001 | Johnson et al. | |
| 6,237,871 | B1 * | 5/2001 | Morand et al. | 242/596.8 |

OTHER PUBLICATIONS

Search Report for Patent Cooperation Treaty application No. PCT/US 01/11198, Date of Mailing Jul. 19, 2001, 7 pages.

Search Report for Patent Cooperation Treaty application No. PCT/US 01/11620, Date of Mailing Jul. 19, 2001, 7 pages.

Search Report for Patent Cooperation Treaty application No. PCT/US 01/11686, Date of Mailing Jul. 11, 2001, 5 pages.

Search Report for Patent Cooperation Treaty application No. PCT/US 01/11131, Date of Mailing Jul. 23, 2001, 7 pages.

Search Report for Patent Cooperation Treaty application No. PCT/US 01/11447, Date of Mailing Jul. 19, 2001, 6 pages.

Search Report for Patent Cooperation Treaty application No. PCT/US 01/11467, Date of Mailing Jul. 19, 2001, 7 pages.

Search Report for Patent Cooperation Treaty application No. PCT/US 01/12091, Date of Mailing Jul. 9, 2001, 4 pages.

Search Report for Patent Cooperation Treaty application No. PCT/US 01/14113, Date of Mailing Jul. 19, 2001, 6 pages.

Search Report for Patent Cooperation Treaty application No. PCT/US 01/40677, Date of Mailing Jul. 19, 2001, 6 pages.

Letter, dated Apr. 4, 1998, and accompanying drawings.

Derwent World Patent Database abstract of DE 3133237: Description of M. Scheepe, "Refill Pack of Moisture–Impregnated Tissues."

Derwent World Patent Database abstract of JP 07–284,461 A: Description of Kusunoki N (KUSU–I), "Toilet Paper Holder," and Patent Abstracts of Japan JP 07–284,461: Description of Kusunoki Nobuaki, "Toilet Paper–Holder Allowing Taking Out Paper Thereof With One Hand."

Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder."

Kotler, Philip, *Marketing Management*, Prentice Hall, Upper Saddle River, NJ, 2000, p. 456–483.

PCT search report for application Ser. No.: PCT/US00/11284, dated Jul. 28, 2000.

Images of Moist Mates product—dispenser and wipes, approximately 1996.

Images of Moist Mates product—dispenser, approximately 2000.

Images of Moist Mates product—refill wipes, approximately 2000.

* cited by examiner

Fig. 11
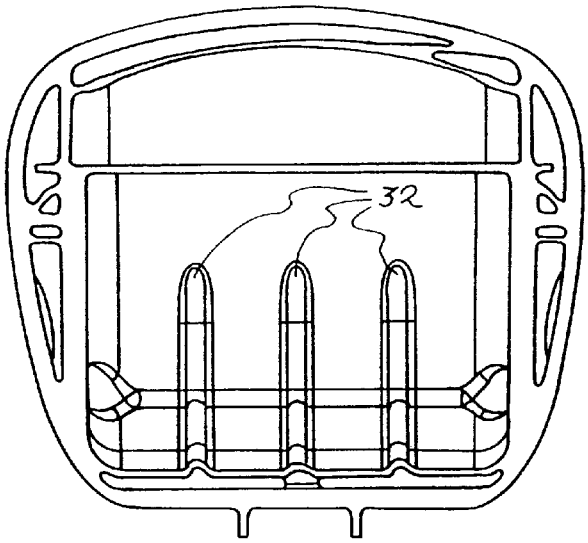
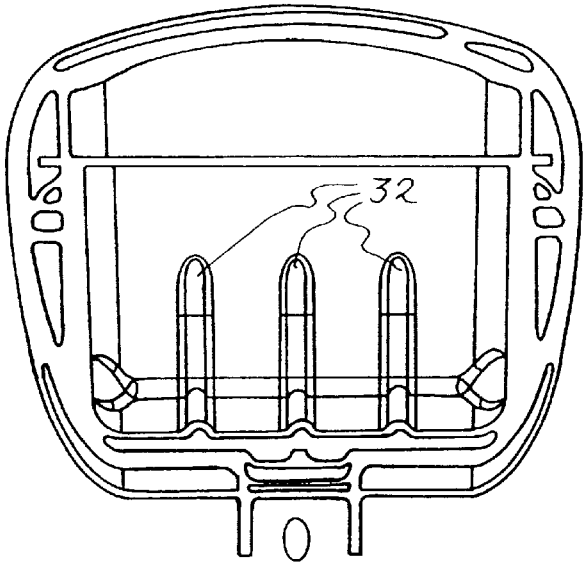
Fig. 12

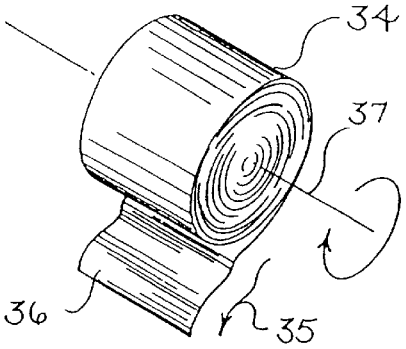
Fig. 18
Fig. 19
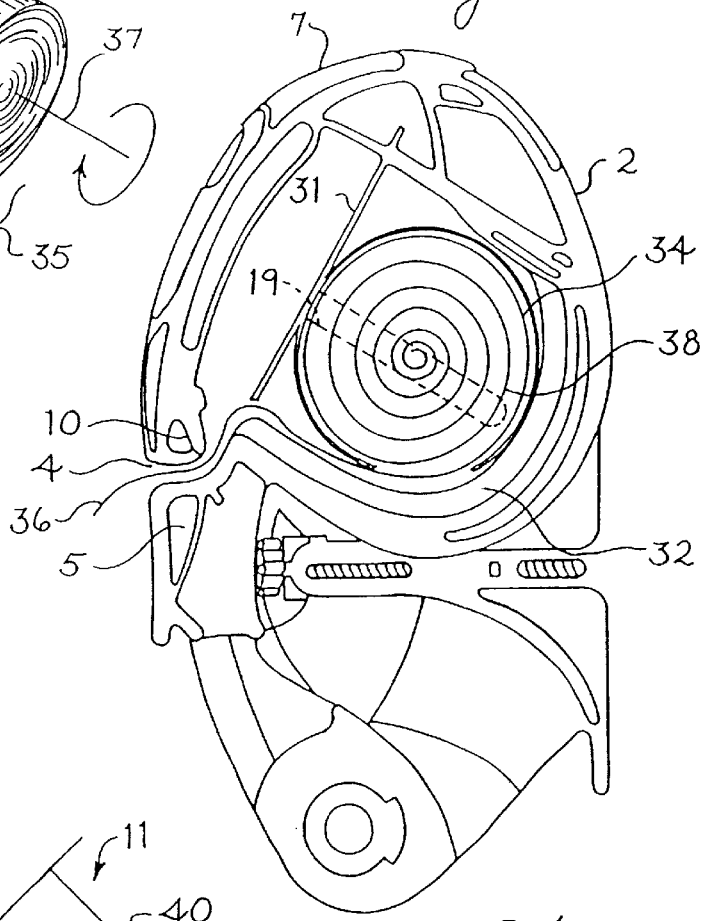
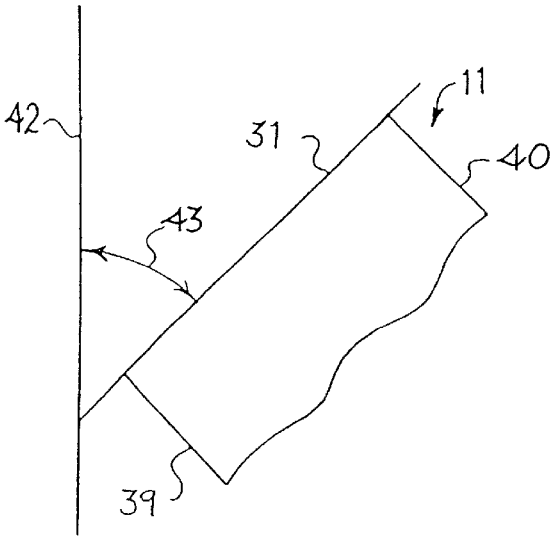
Fig. 20
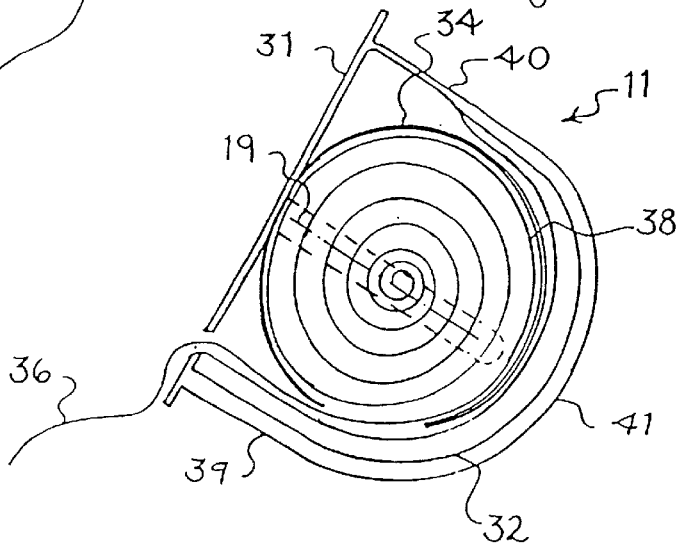
Fig. 21

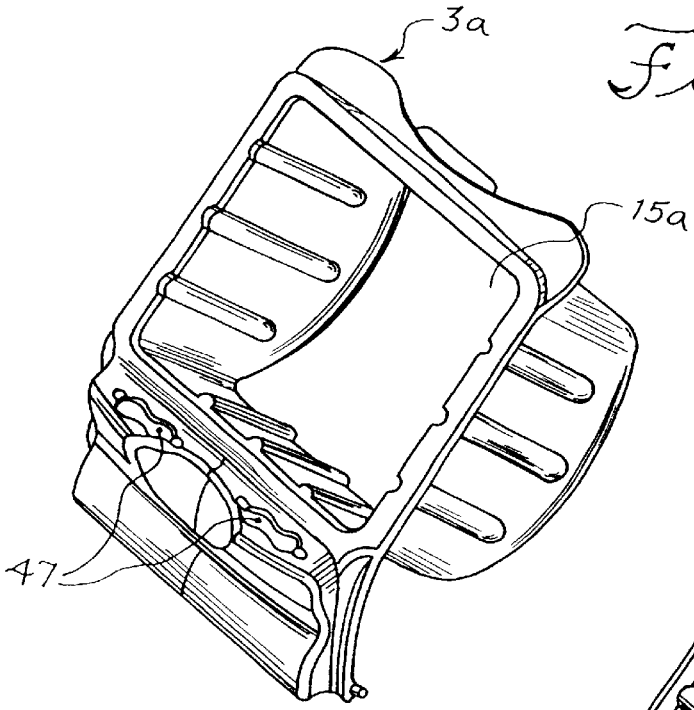
Fig. 26
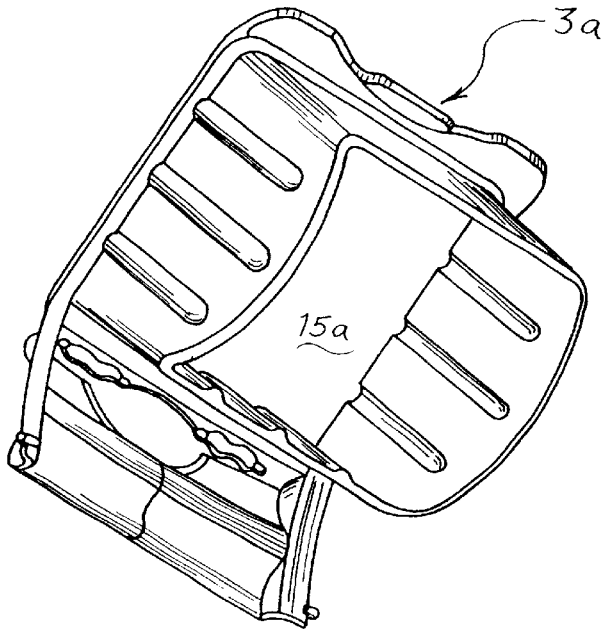
Fig. 27
Fig. 28
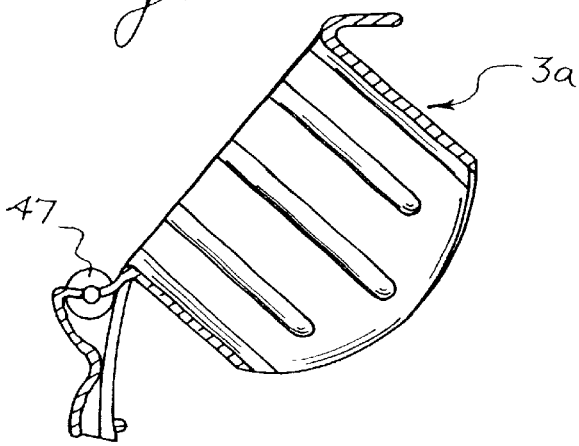

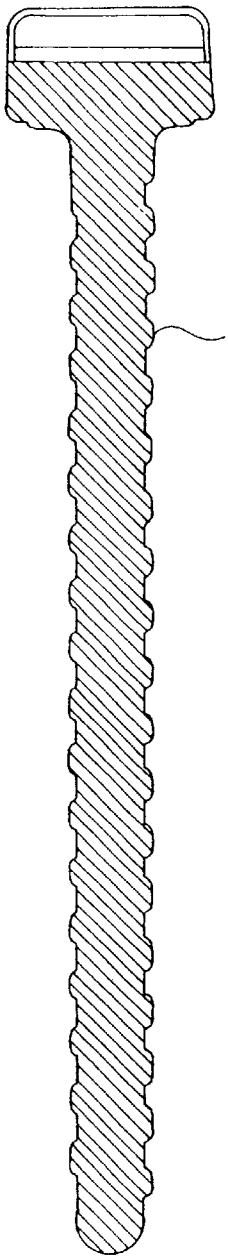
Fig. 46
Fig. 47
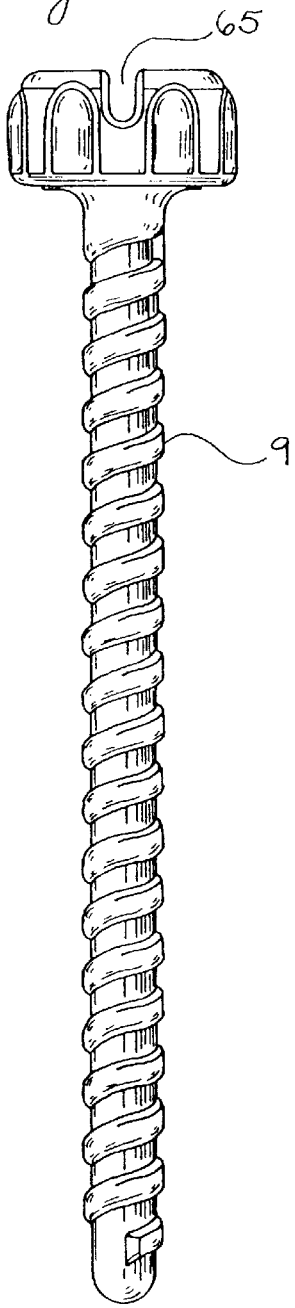
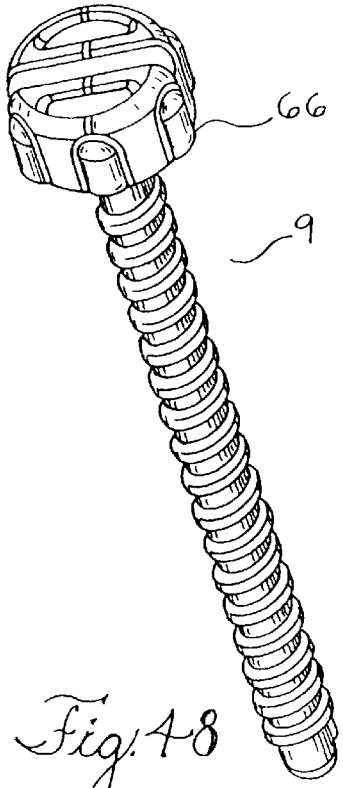
Fig. 48
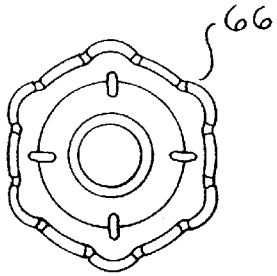
Fig. 49
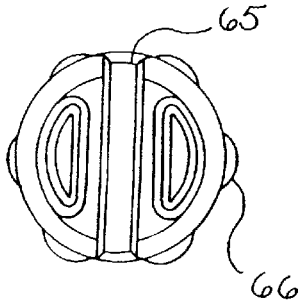
Fig. 50

SYSTEM AND DISPENSER FOR DISPENSING WET WIPES

This application is a continuation in part of pending U.S. application entitled Dispenser For Premoistened Wipes, Ser. No. 09/545,995, which was filed on Apr. 10, 2000, and which claims the benefit of the filing date pursuant to 35 U.S.C. §119(e) of, Provisional Application Serial No. 60/132,024, filed Apr. 30, 1999, the disclosures of which are hereby incorporated by reference.

FIELD OF THE INVENTION

This invention relates to the use of wet or premoistened products alone or in conjunction with other products or systems to dispense such products.

BACKGROUND OF THE INVENTION

Wet products such as wet wipes have many applications. They may be used with small children and infants when changing diapers, they may be used for house hold cleaning tasks, they may be used for cleaning hands, they may be used as a bath tissue, they may be used as by a caregiver to clean a disabled or incontinent adult or they may be used in and for a whole host of other applications, where it is advantages to have a wipe or towel that has some moisture in it.

Wet wipes have been traditionally dispensed in sheet form from a tub like container with a hinged lid on the top. The lid is opened and individual or singularized sheets of the wipes are removed. Another type of container that has been used for wet wipes provides a roll of wipes in which the wipes are pulled from the top of the container in a direction that is parallel to the axis of the roll. These wipes are pulled from the center of a hollow coreless roll that has perforated sheets. These containers generally have a snap top lid that is opened to expose a piece of the wipes that can then be pulled to remove the desired amount of wipes. Once pulled out the wipes can then be torn off, usually at a perforation, and the lid closed.

Wet wipes can be any wipe, towel tissue or sheet like product including natural fibers, synthetic fibers, synthetic material and combinations thereof, that is wet or moist. Examples of wet wipes are disclosed in application Ser. Nos. 09/564,449; 09/564,213; 09/565,125; 09/564,837; 09/564,939; 09/564,531; 09/564,268; 09/564,424; 09/564,780; 09/564,212; 09/565,623, all filed May 4, 2000 titled Ion-Sensitive, Water-Disperible Polymers, A Method of Making Same And Item Using Same, pending application Ser. No. 09/223,999 titled Ion-Sensitive Hard Water Dispersible Polymers And Applications Therefore, filed Dec. 31, 1998 the disclosures of which are incorporated herein by reference.

SUMMARY OF THE INVENTION

DRAWINGS

Figure 2A:
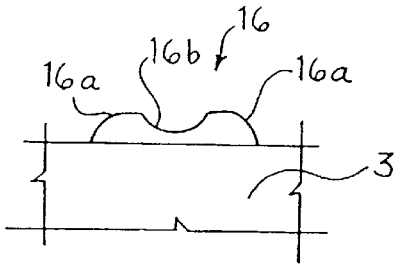
FIG. 2 is an exploded view of a dispenser and cartridge.

FIG. 2*a* is a plan view of the front of the tray.

Figure 3:
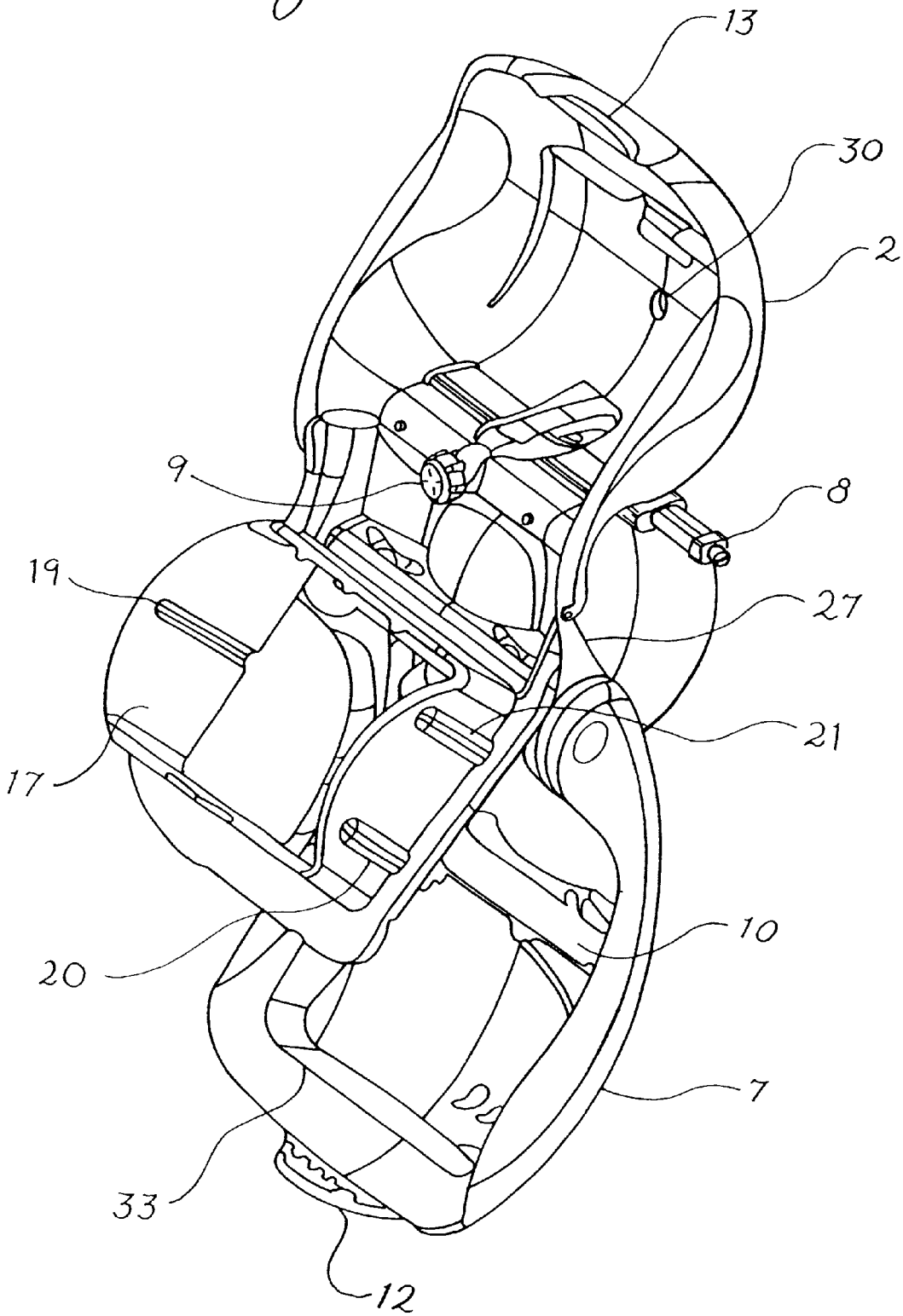

FIG. 3 is a prospective view of an open dispenser.

Figure 4:
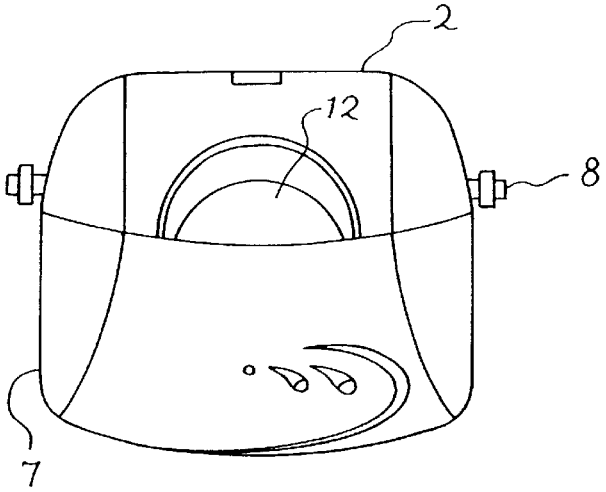

FIG. 4 is a top view of a dispenser.

Figure 5:
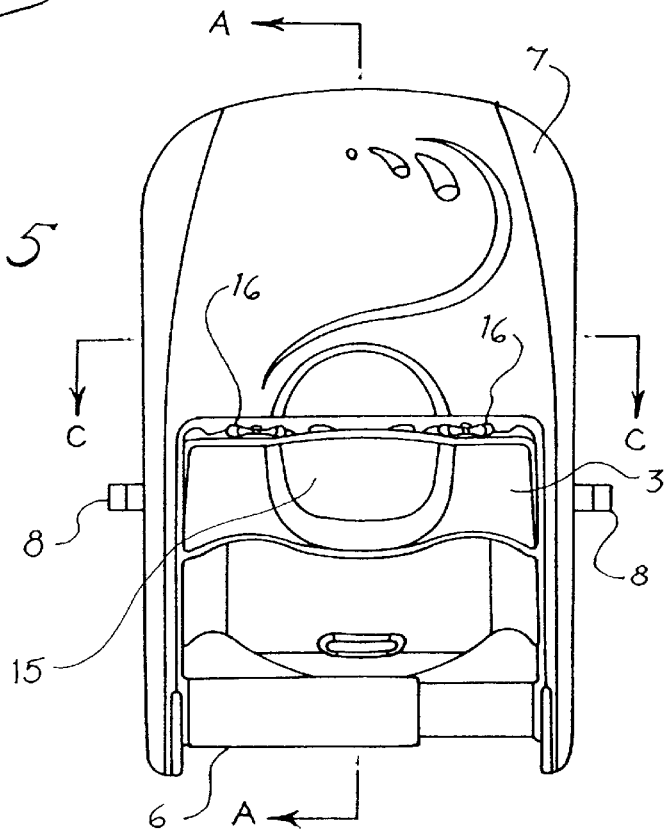

FIG. 5 is a front view of a dispenser.

Figure 6:
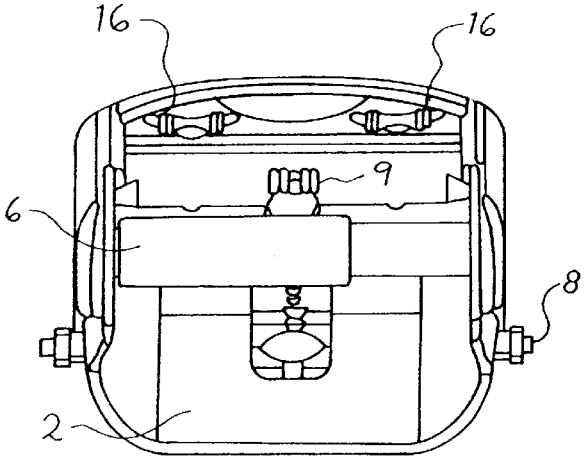

FIG. 6 is a bottom view of a dispenser.

Figure 7:
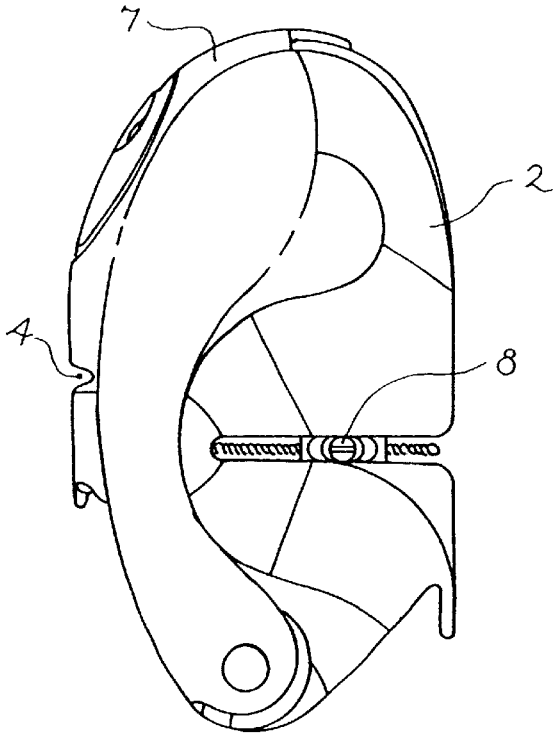

FIG. 7 is a side view of a dispenser.

Figure 8:
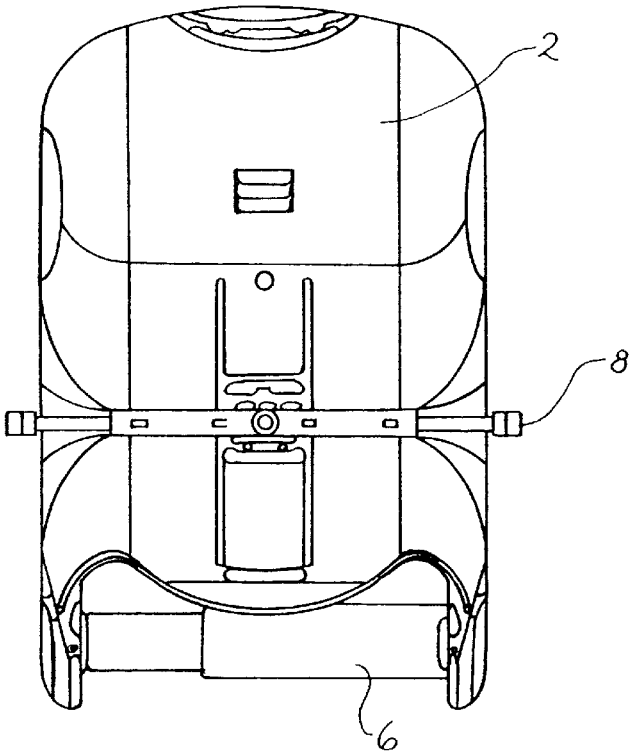

FIG. 8 is a back view of a dispenser.

Figure 9:
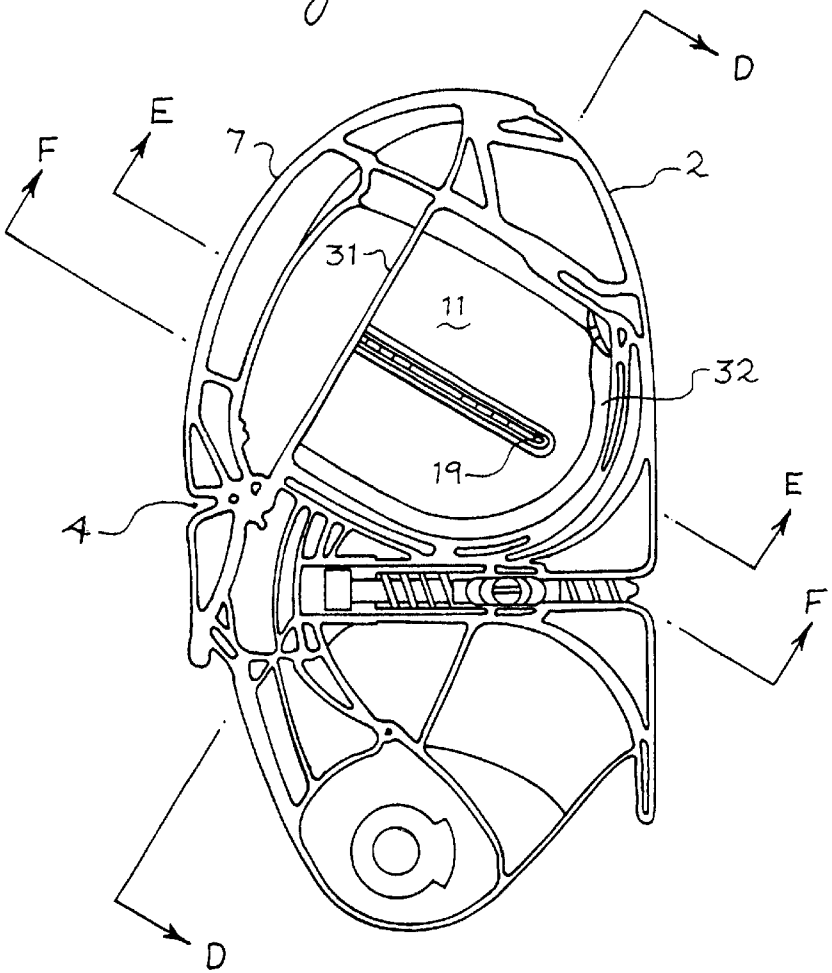

FIG. 9 is a cross section view of a dispenser and cartridge taken along line A—A of FIG. 5.

Figure 10:
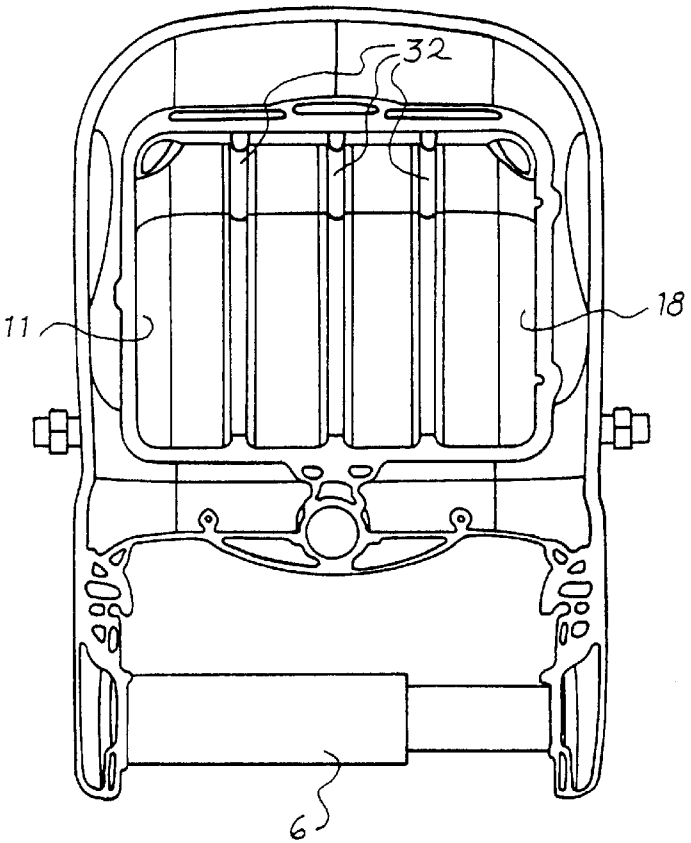

FIG. 10 is a cross section view along line D—D of FIG. 9.

FIG. 11 is a cross section view along line E—E of FIG. 9.

FIG. 12 is a cross section view along line F—F of FIG. 9.

Figure 13:
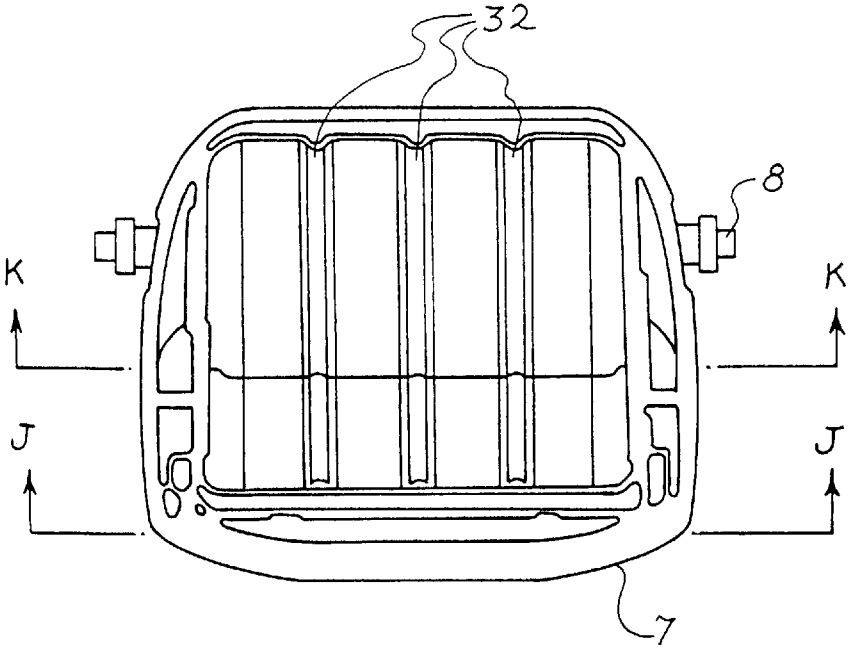

FIG. 13 is a cross section view of a dispenser and cartridge taken along line C—C of FIG. 5.

Figure 14:
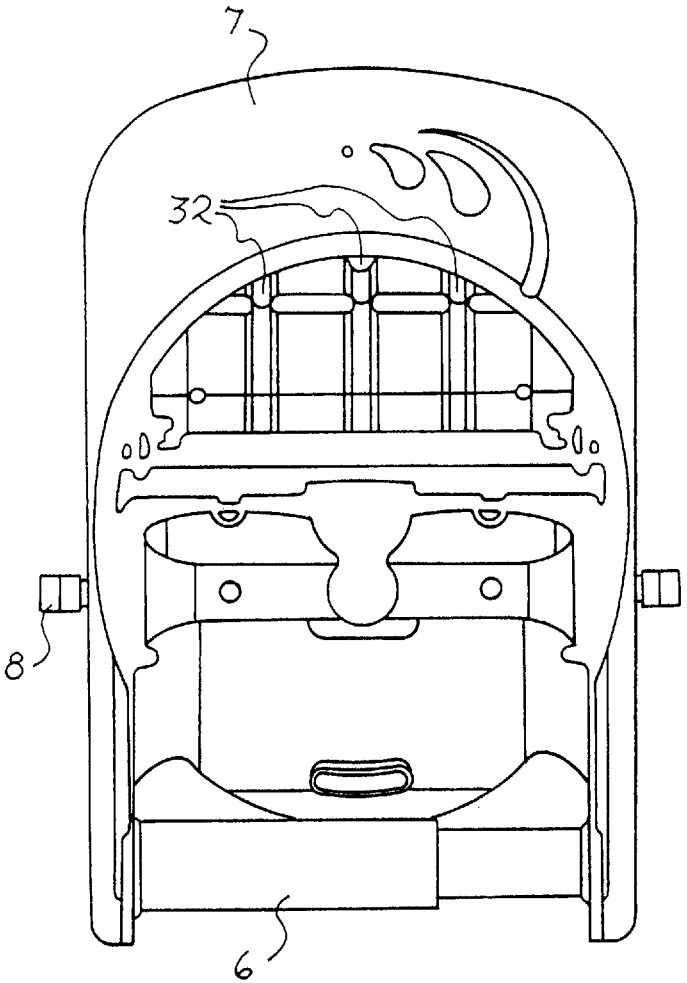

FIG. 14 is a cross section view along line J—J of FIG. 13.

Figure 15:
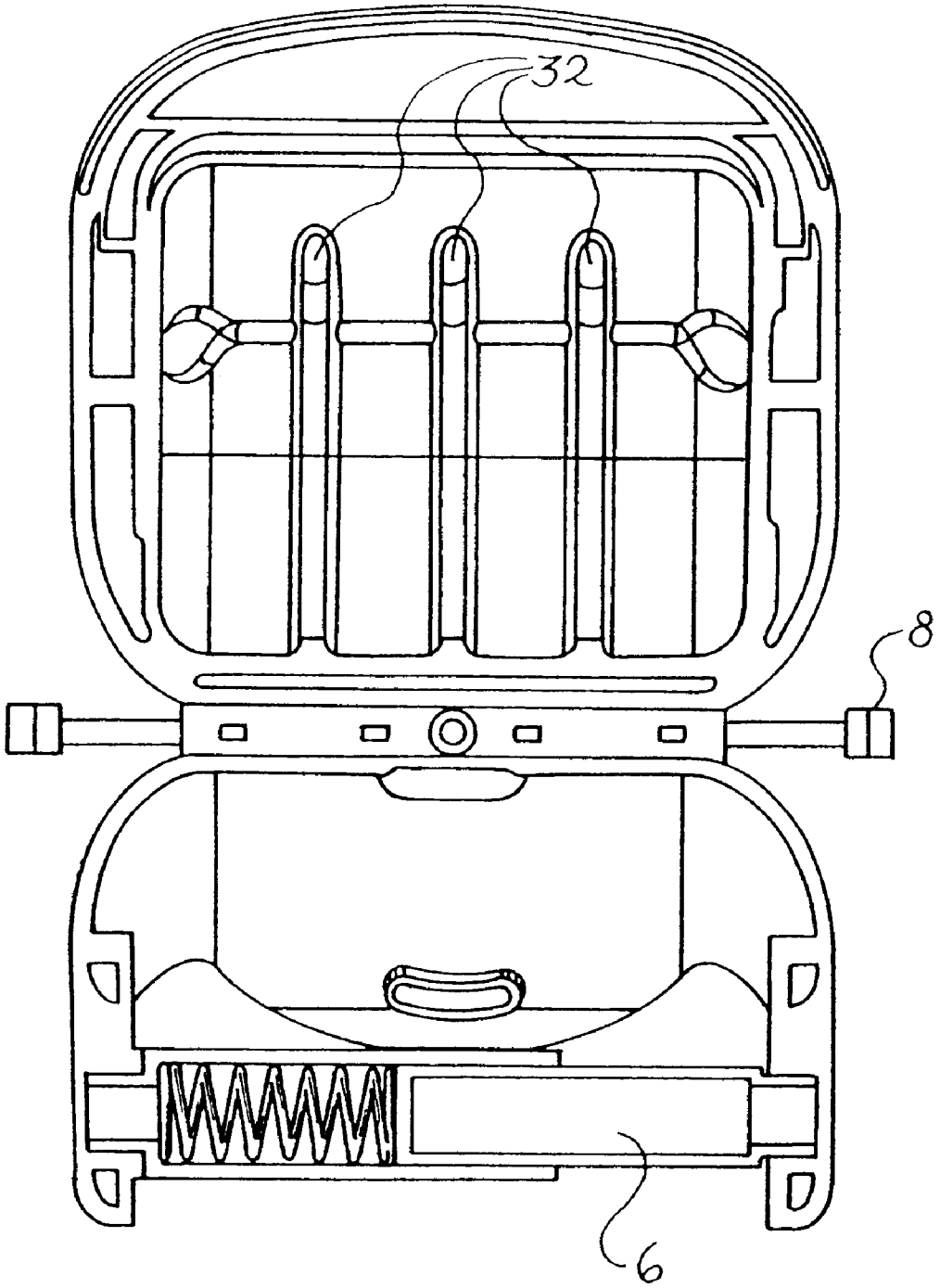

FIG. 15 is a cross section view along line K—K of FIG. 13.

Figure 16:
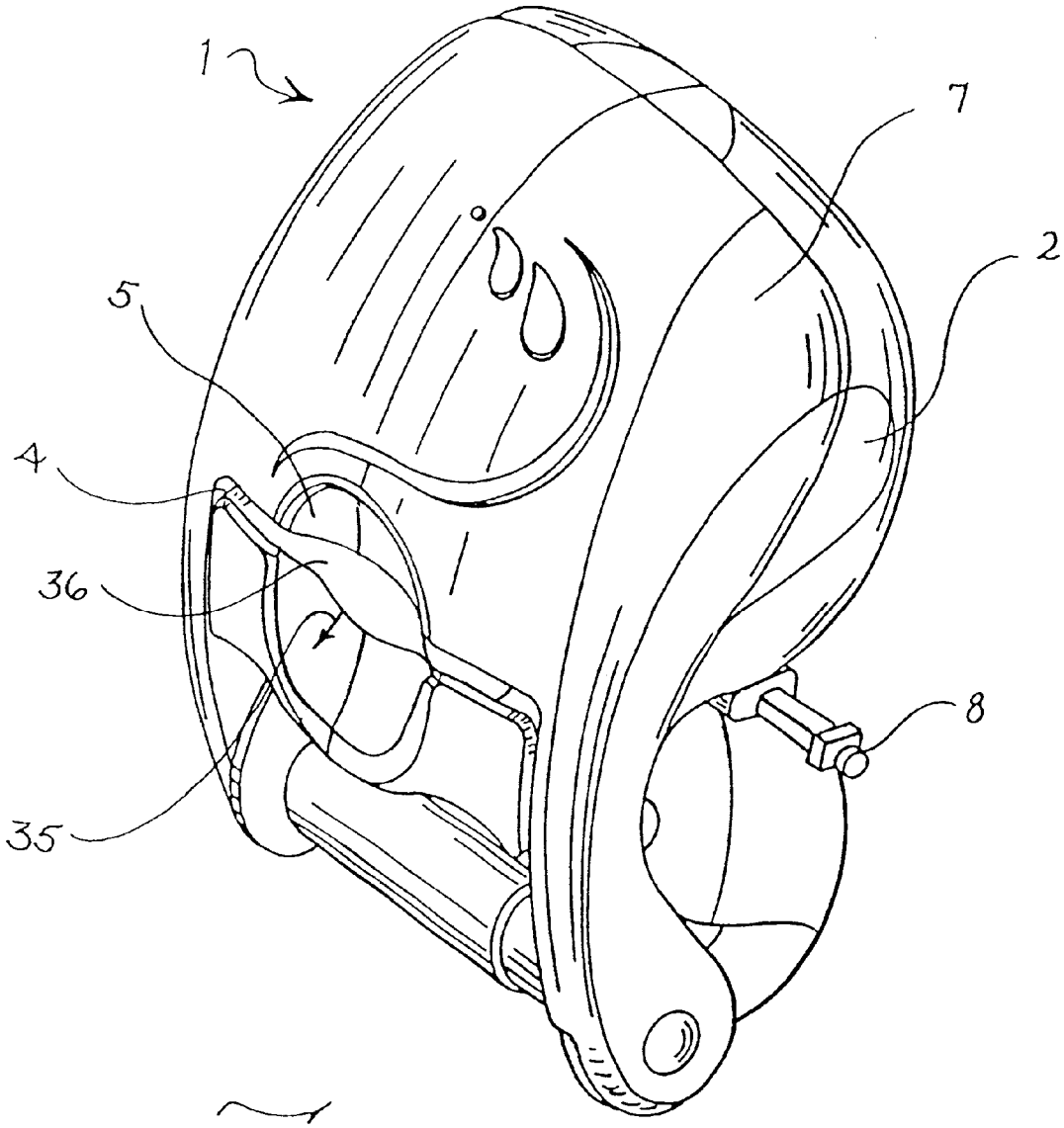

FIG. 16 is a prospective view of a dispenser with a wet wipe.

Figure 17:
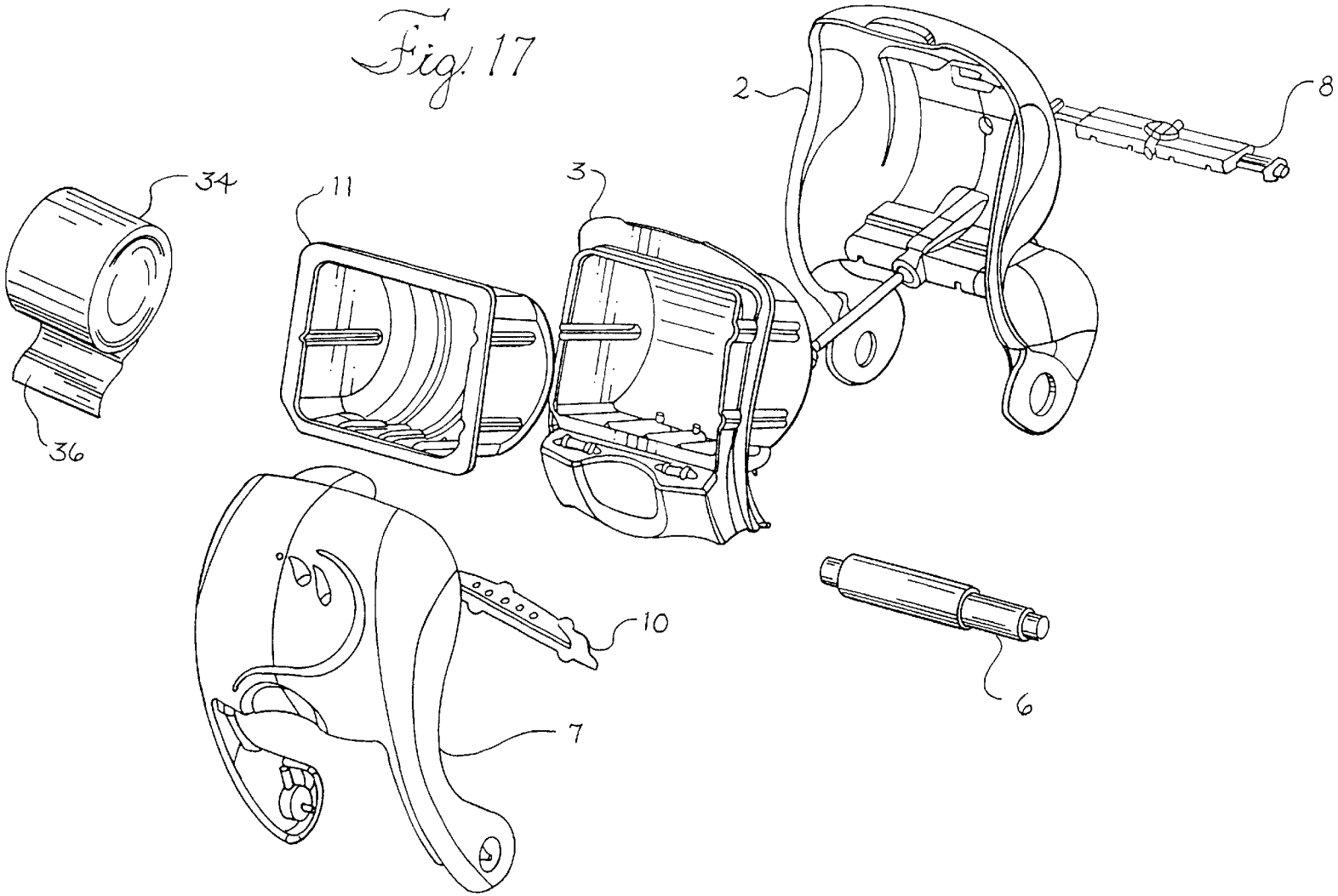

FIG. 17 is a prospective view of a dispenser, a cartridge and a roll of wet wipes.

FIG. 18 is a prospective view of a roll of wet wipes

FIG. 19 is a cross section view of a dispenser, a cartridge and a roll of wet wipes.

FIG. 20 is a cross section view of a cartridge and a roll of premoistened wipes.

FIG. 21 is a cross section view of a cartridge.

Figure 22:
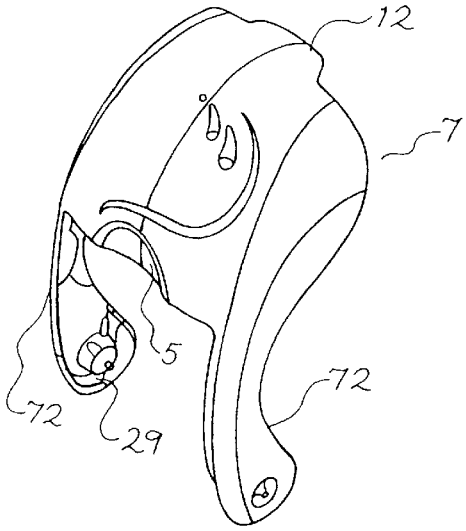

FIG. 22 is a prospective view of the outside of a cover.

Figure 23:
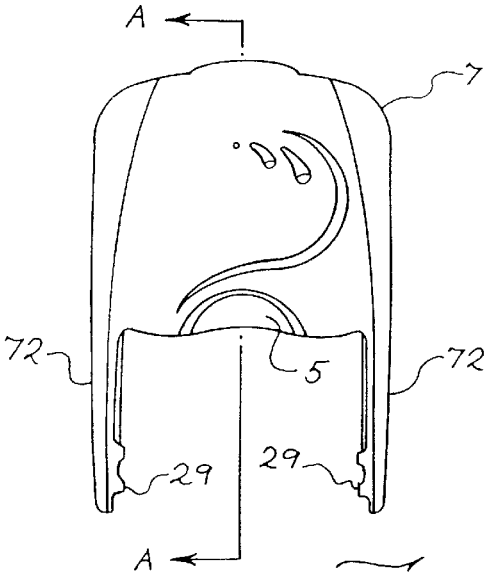

FIG. 23 is a front view of the outside of a cover.

Figure 24:
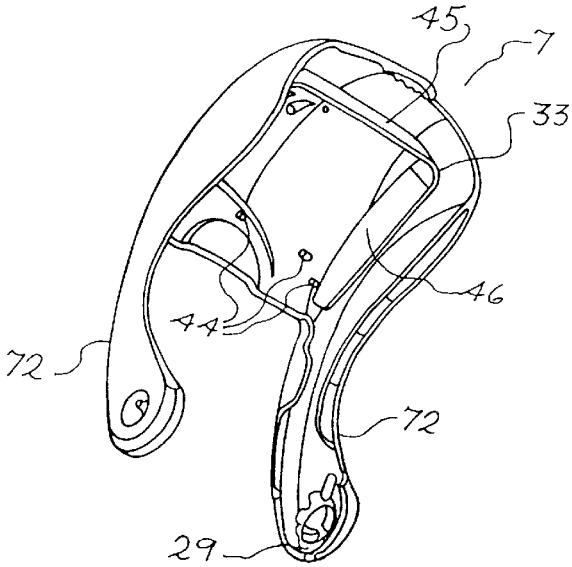

FIG. 24 is a prospective view of the inside of a cover.

Figure 25:
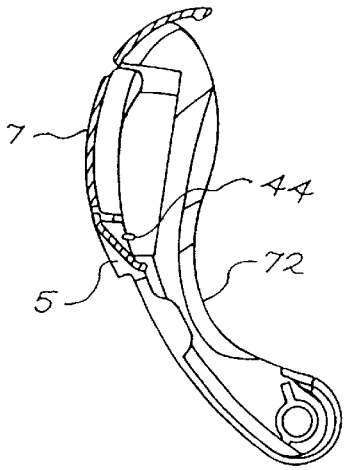

FIG. 25 is a cross section view of a cover.

FIGS. 26–28 are views of a tray.

Figure 29:
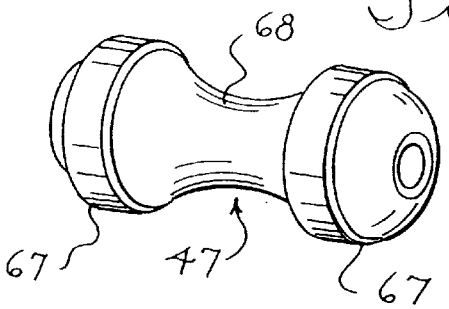
Figure 30:
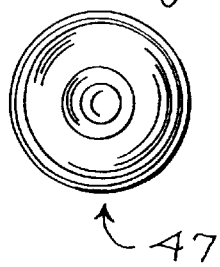
Figure 31:
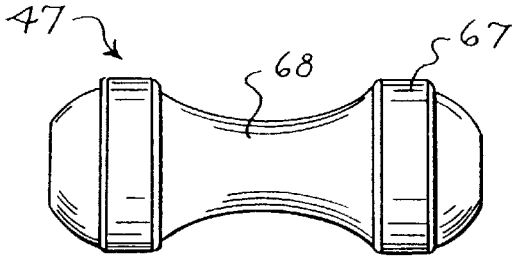

FIGS. 29–31 are views of a roller.

FIGS. 32–37 are views of a wiper.

Figure 35:
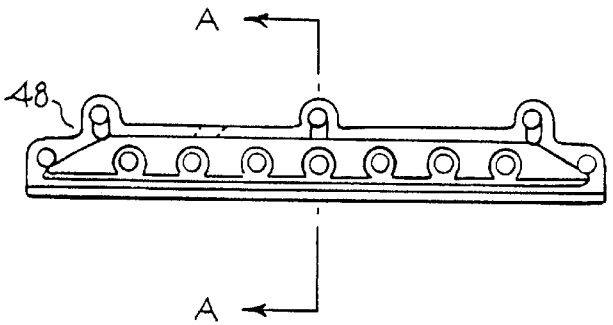
Figure 36:
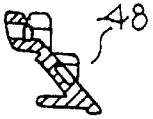

FIG. 36 is a view along line A—A of FIG. 35.

Figure 32:
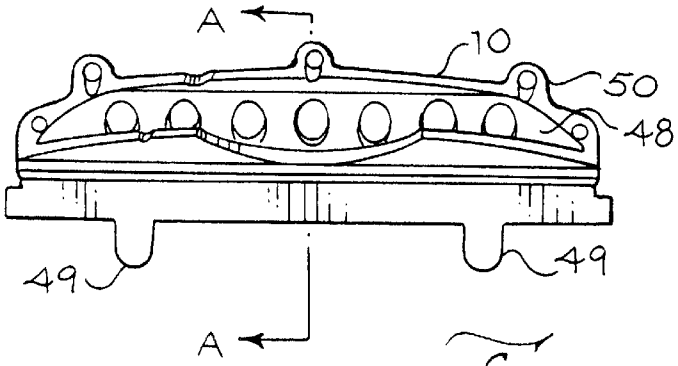
Figure 34:
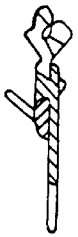

FIG. 34 is a view along line A—A of FIG. 32.

Figure 38:
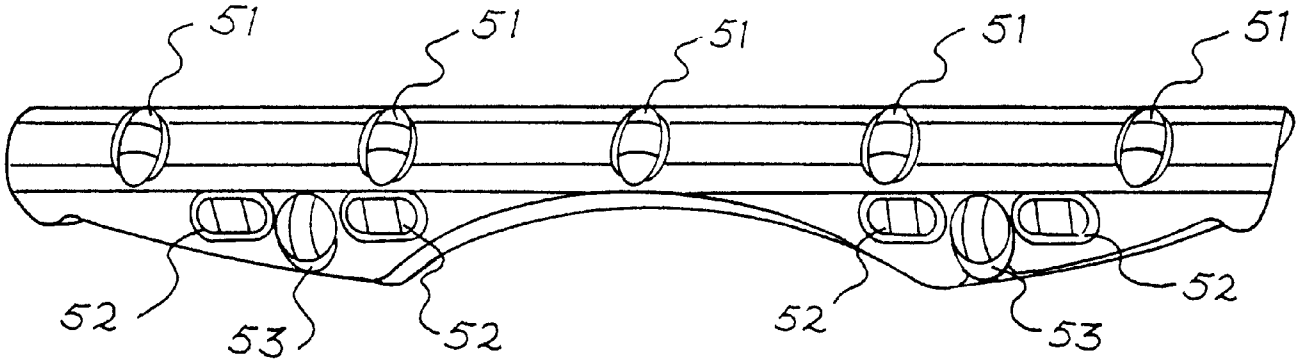
Figure 39:
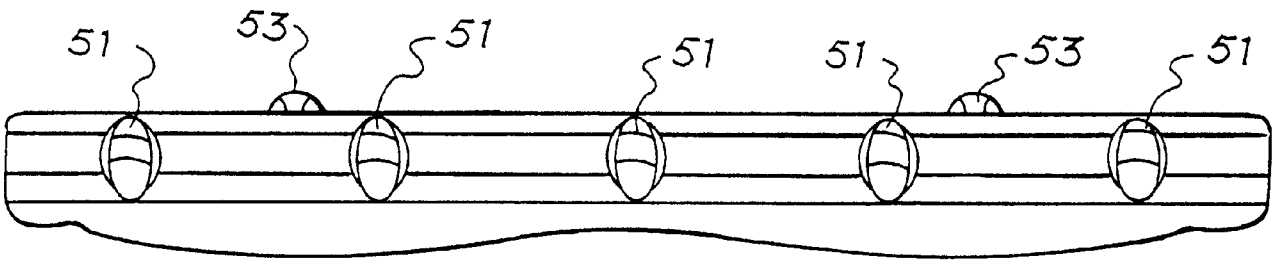
Figure 42:
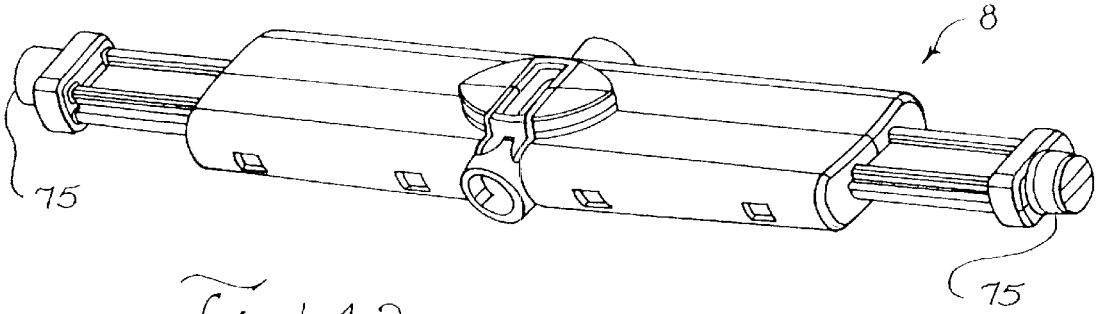

FIGS. 38–39 are views of a wiper.

Figure 40:
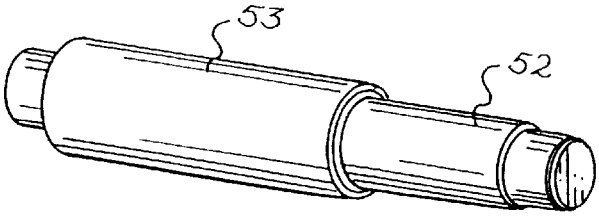
Figure 41:
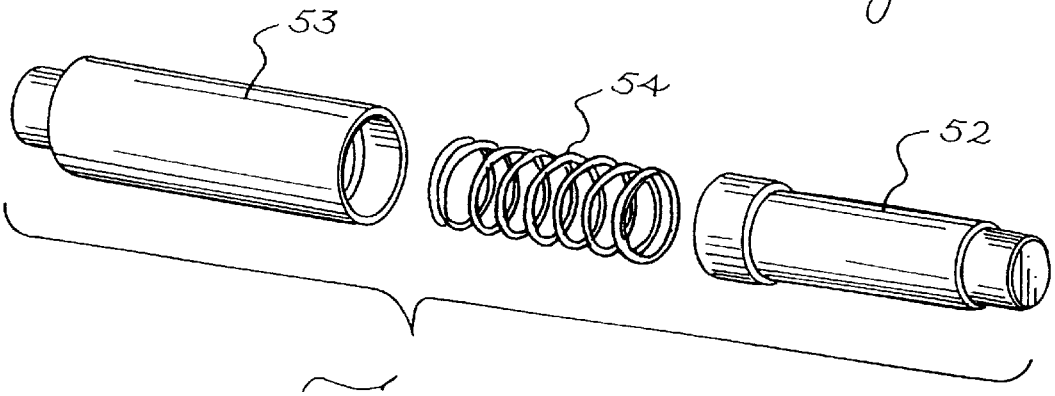
Figure 33:
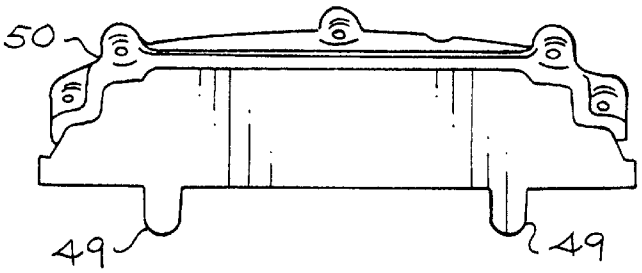
Figure 37:
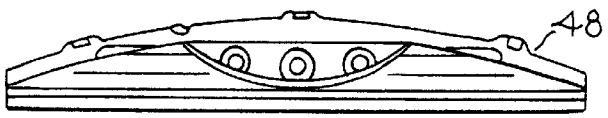

FIGS. 40–41 are views of a roller.

FIGS. 42–45 are views of a mounting assembly.

FIGS. 46–50 are views of a screw used in conjunction with the mounting assembly.

Figure 51:
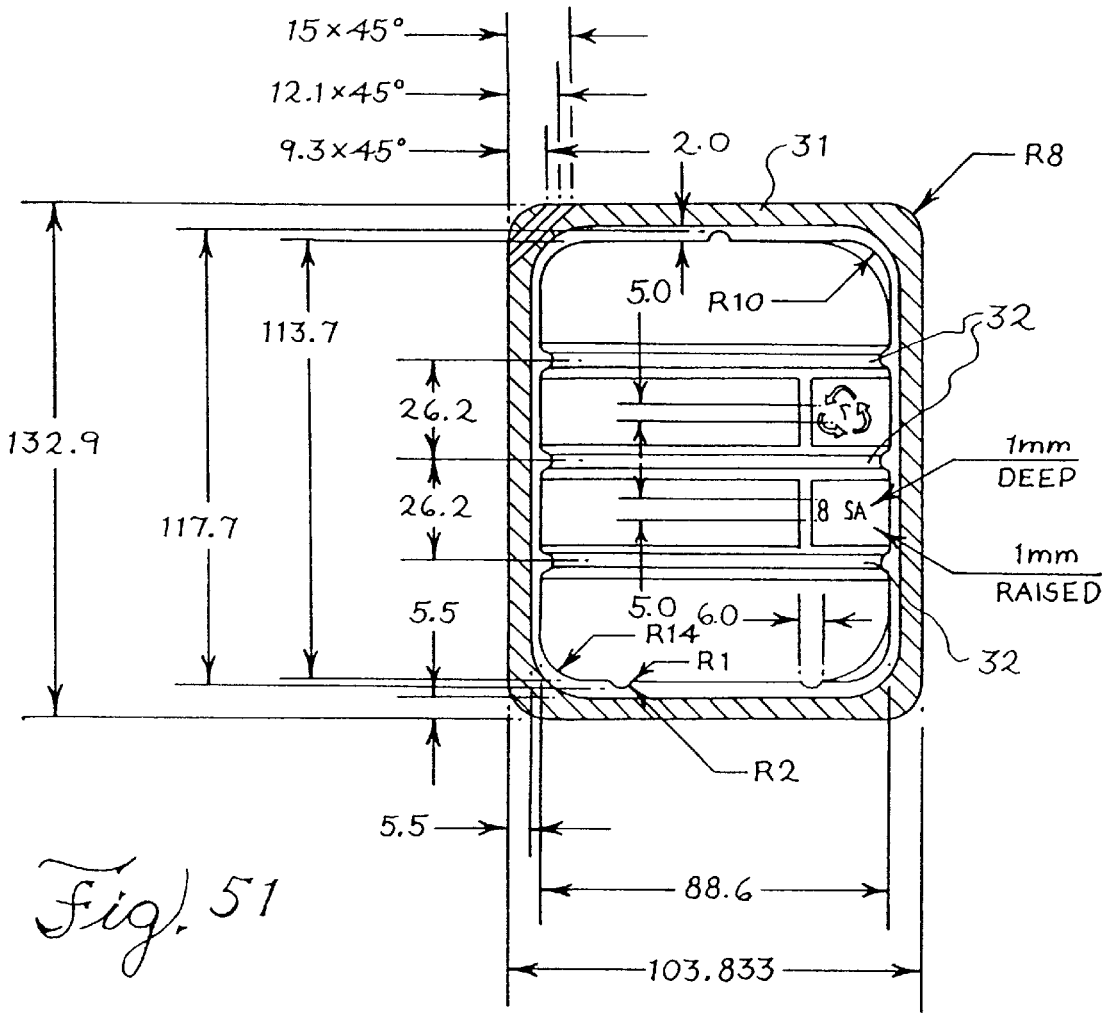
Figure 52:
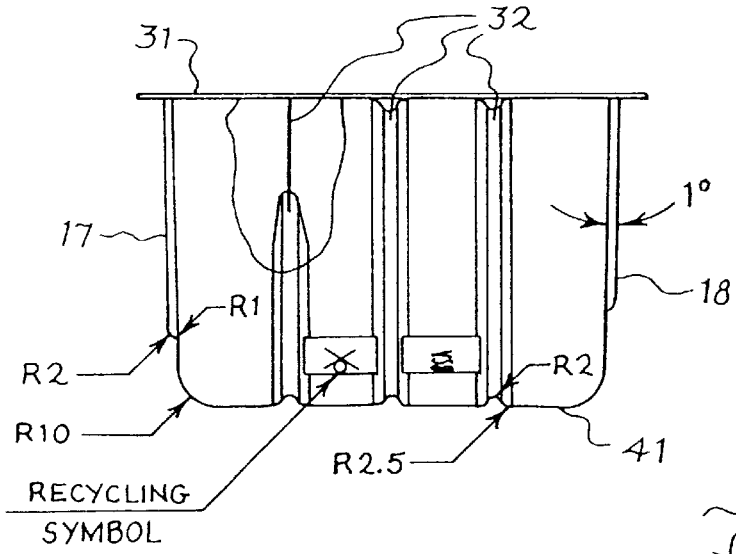
Figure 53:
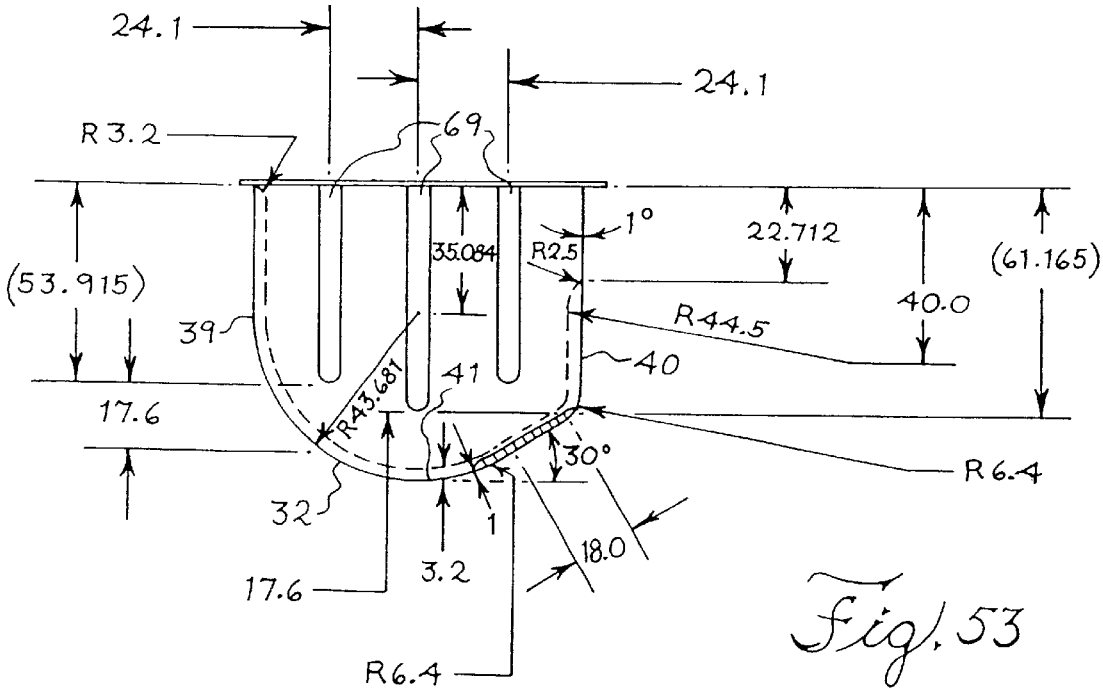

FIGS. 51–53 are views of a tray.

Figure 54:
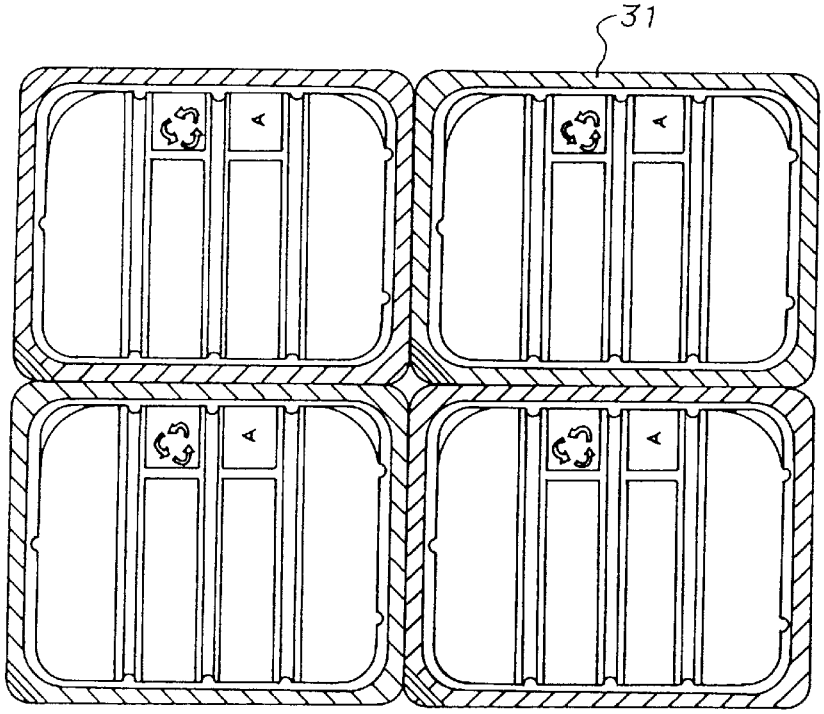

FIG. 54 is a top view of a package of cartridges.

Figure 55:
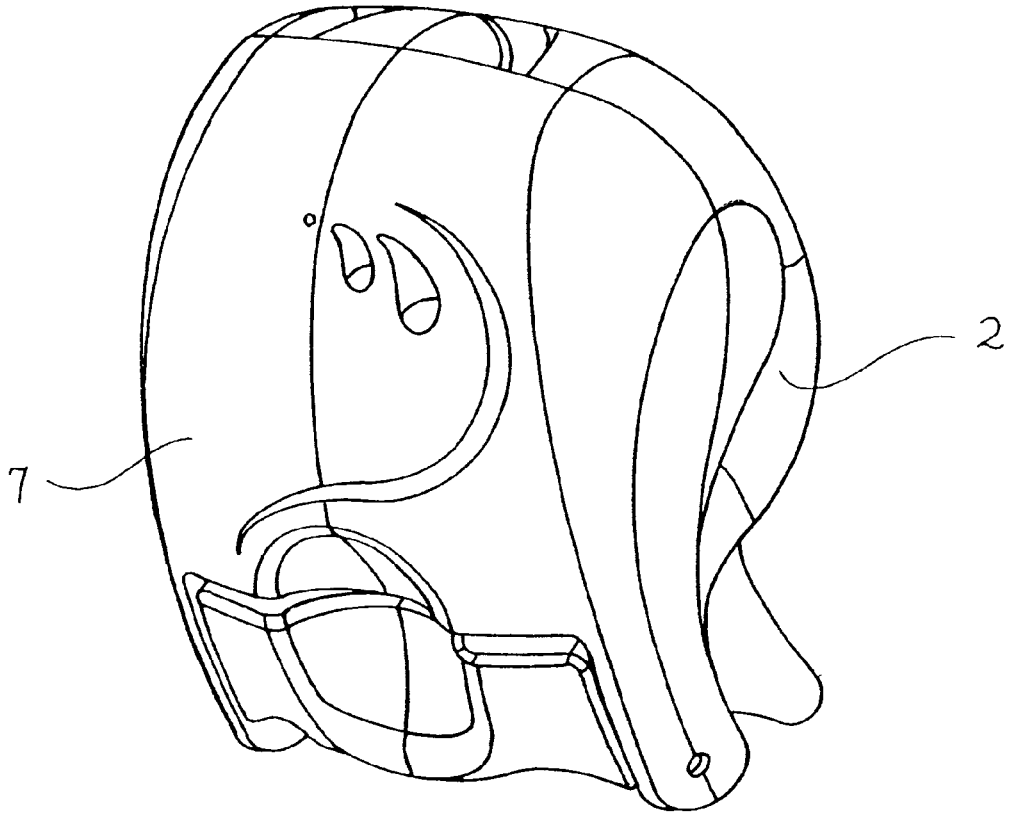

FIG. 55 is a prospective view of a dispenser.

Figure 56:
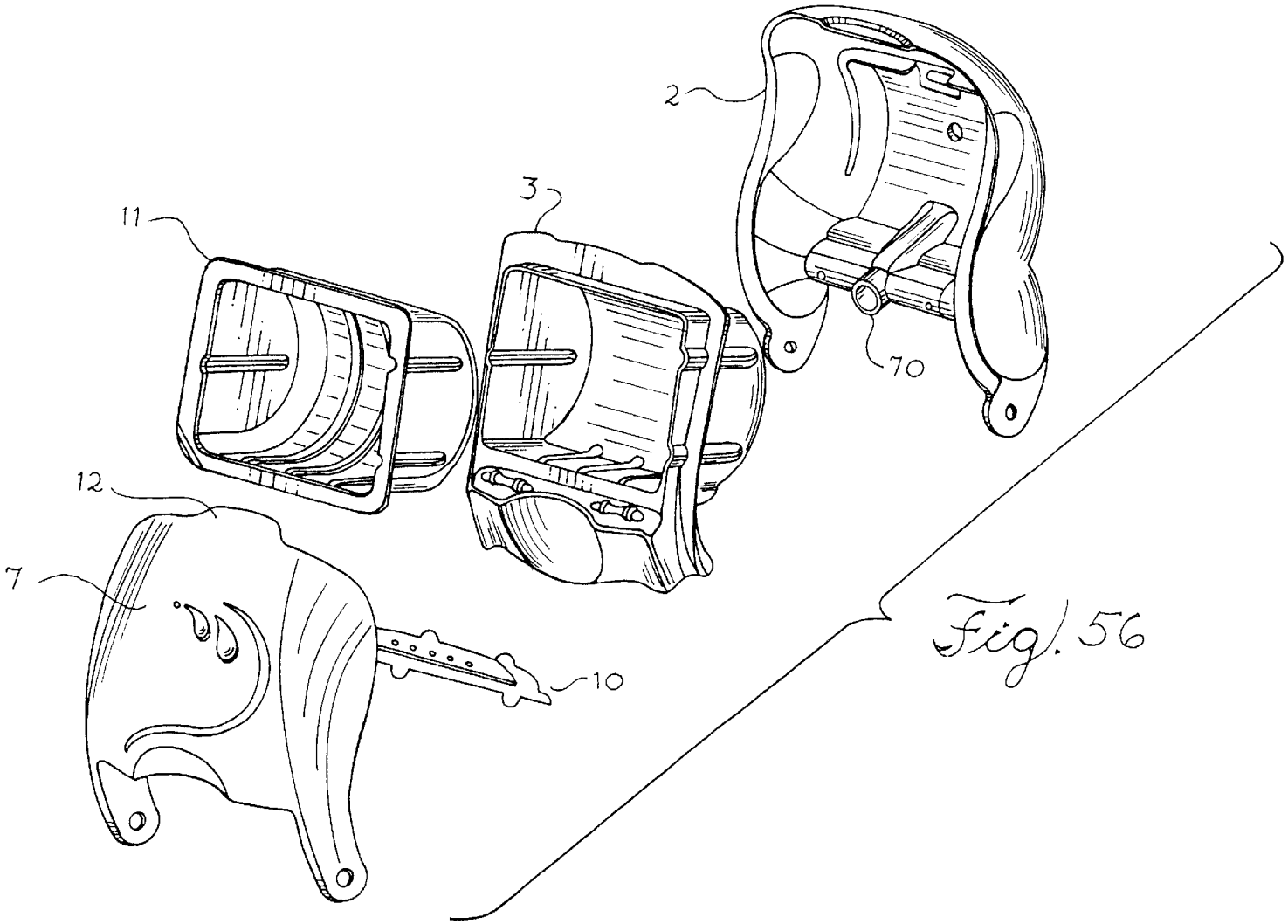

FIG. 56 is an exploded view of a dispenser and cartridge.

DETAILED DESCRIPTION OF PRESENTLY PREFERRED EMBODIMENTS OF THE INVENTION

A system for dispensing wet wipes is provided, which in general may have a housing, a cover, and a cartridge having a roll of wet wipes. The cartridge is placed in the housing and then the wipes can be removed from the dispenser.

For example, the system may have a dispenser that has a housing, which is capable of being mounted to a surface, such as a wall, a cabinet, an existing bath tissue dispenser, a toilet, a toilet tank, a stall wall, or a dashboard of an automobile. The dispenser has an opening that holds a cartridge, which contains the wet wipes. These cartridges are sealed and may be grouped in packages of multiple cartridges. Thus, a package of cartridges may be provided to a user. The user may then select and open one of the cartridges, put it in the dispenser, and use the wipes as needed. When the wipes are used up, the user may simply replace the old cartridge with a new one. Thus, this system enables the user to conveniently obtain and keep several cartridges of wipes on hand and then use the wipes as needed. By using sealed cartridges to refill the dispenser the user is using a new and fresh product each time and a product that is in contact with fresh surfaces.

By way of example, referring to FIGS. 1 through 15, there is provided a dispenser 1, which has a housing 2, a tray 3, a cover 7, and a mounting assembly 8. The tray and the cover form a gap 4, through which a wet wipe can extend. The tray and cover additionally recesses 5, that form an indentation that provides a finger hold, or point where a user can grasp the wet wipe to pull it from the dispenser. Although optional, this dispenser is also provided with a roller 6 for mounting and dispensing toilet tissue.

Figure 1:
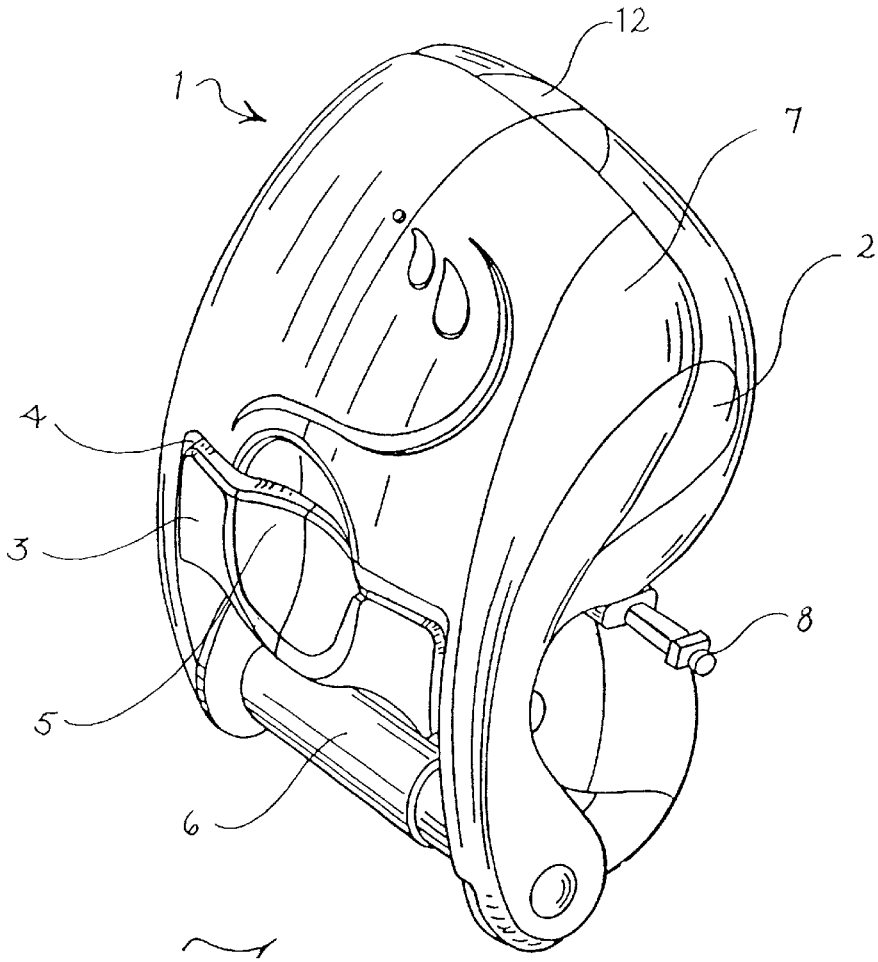
FIG. 1 is a prospective view of a dispenser.
Figure 2:
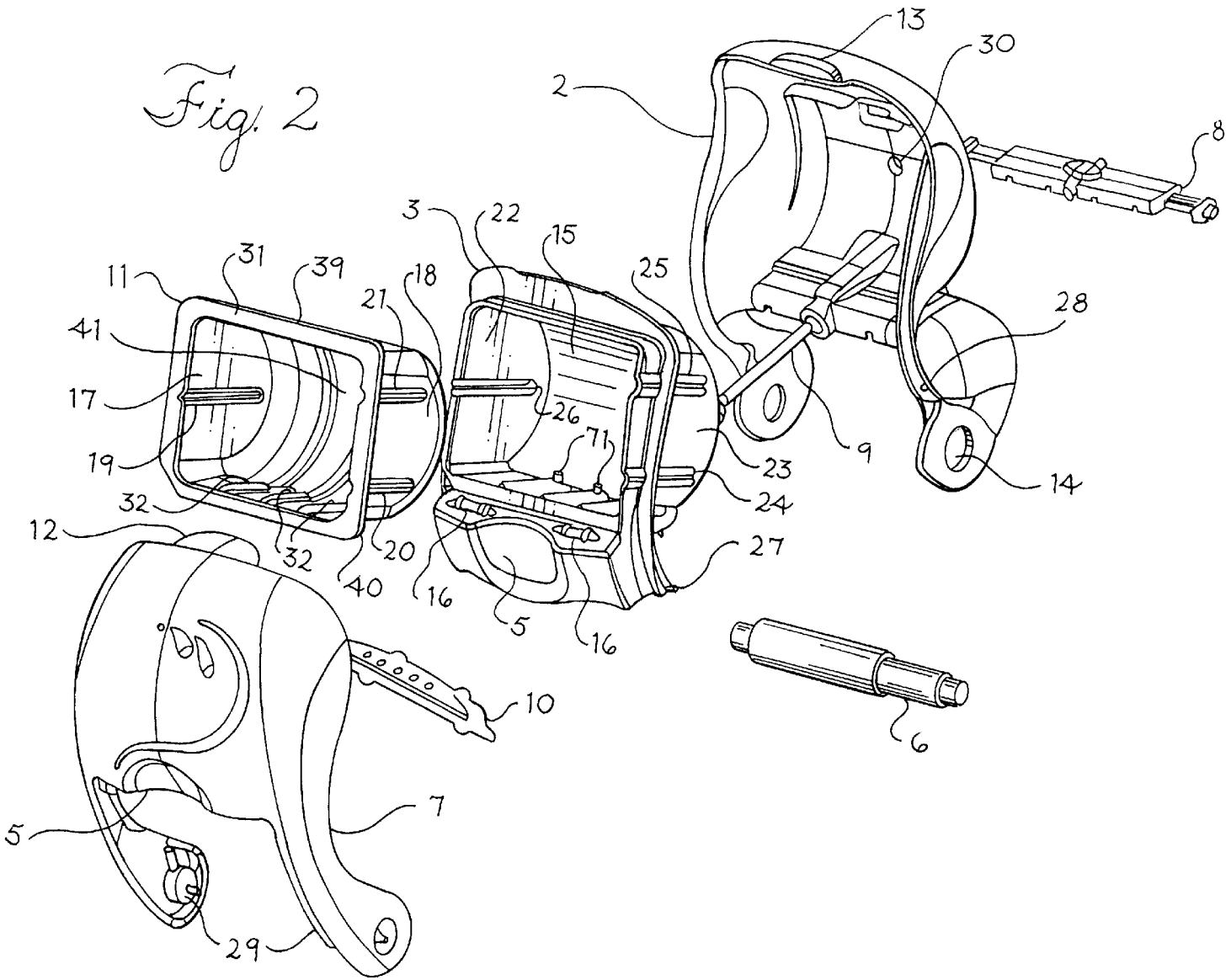

FIG. 1 shows the dispenser with the cover closed. FIG. 2 show the dispenser and a cartridge in a exploded view. FIG. 3 show the dispenser assembled and in a fully opened condition. The fully opened condition provides access to screw 9.

The housing may be made from any suitable material, such as plastic, wood. ceramic, porcelain, glass, paper, metal, thermoplastic elastomers, or composite materials. For example, polypropylene, polyesters such as polybutylene terephthalate (Pbt), Pbt glass filled, Pbt 15% glass filled, fiberglass, carbon fiber, and acetyl butyl styrene (ABS) may be used to make the housing. The housing may have different shapes and sizes. When the housing is intended for use in a home it is desirable that the housing be of a size that is similar to conventional bath tissue roller mounts. It is particularly desirable that the dispenser be as compact as possible for home use. Further if the housing is in the range of from about 4½ inches to 6⅞ inches in width it will be able to fit in or mount to the vast majority of toilet paper holds that are in existing houses. Preferably the width of the housing may be less than about 6⅞ inches, and less than about 7 inches. This size provides an added benefit of enabling one size of dispenser to be used in the vast majority of applications in the home. When the housing is used for industrial purposes or in commercial applications it may be desirable to make the housing substantially larger.

The housing may be configured as show in FIG. 1 to mount onto or into a conventional wall mount toilet paper holder. It may also be mounted directly to a wall, for example by way of a screw, through mounting hole 30, or by other means of fixing the housing to a wall or surface, such as glue, nails, screws, rivets, magnetic attachments, staples, engaging brackets and pressure mountings against the sides of a conventional wall mount for toilet tissues. The housing also may have a tab 13 that engages a lock 12 on the cover to keep the cover closed, yet provide an easy way to open the dispenser. Various other ways to lock or fix the cover to the housing may also be employed. For example, a lock and key approach may be desirable in commercial application or houses where there are small children present.

The housing may also have an opening 14 that is made to receive cover mounts 29. The opening 14 and the cover mounts 29 may further be configured to receive a convention toilet tissue roller. The housing may further have an opening 28 for receiving a pin 27 on the tray 3.

The cover 7 may be made of any similar material to the housing, it may be the same as or a different material from the housing. The cover may be clear or have a window for viewing the amount of wet wipes that remain in the dispenser. It is noted, however, that because the cover is in direct contact with the wet wipe, the cover forms the top of the cartridge when the cartridge is inserted into the dispenser and the cover closed, wood or any other material that would support bacterial growth would not be favored. It is preferred that all materials that are in contact with the wet wipes be made from materials that discourage, or do not support bacterial growth. Moreover, anti-bacterial agents may be added to the materials that are in contact with the wet wipes.

The cover is designed to cooperate with the cartridge 11 to form a barrier to moisture loss from the wet wipes. The cover may also be designed to cooperate with other components of the dispenser system to form a moisture barrier. The dispenser can maintain wet wipes in a moist condition when fully closed for at least 1 day, for at least 2 days, for at least 5 days and for at least 14 days, and preferably for more than 14 days at room conditions of 73 degrees F. and 50% relative humidity. The dispenser when fully closed can maintain at least about 15%, at least about 20%, at least about 25% and at least about 50% of the moisture of the wipe for a 14 day period at 73 degrees F. and 50% relative humidity.

The cover may further be designed to cooperate with the cartridge 11, or other components of the dispenser system, to for a barrier to contamination of the wipes within the dispenser. Thus, the cover in cooperation with the cartridge, or other components of the dispenser system, may form a barrier to dirt, dust, mold spores and bacteria.

The cover may be provided with an inside rim 33 (see, e.g., FIG. 3) and a wiper 10 (see, e.g., FIGS. 2 and 3). The cover inside rim and wiper cooperate with the lip 31 of the cartridge. In this way when the cover is closed the inside rim is brought against the lip of the cartridge and the wiper is similarly brought against the tray including the guides, as well as the lip of the cartridge.

The distance between the inside of the cover where the wiper is located and the tray may be less than the height of the wiper. Thus, in this configuration the wiper would be placed under compression against the lip, the tray, or the guides 16 or all of them depending on the position of the wiper. Here the wiper would exert pressure on the wet wipes. The wiper may also be positioned so that it contacts the wet web but does not exert pressure against it, or be positioned so that it is a short distance above the wet web. The amount of pressure that the wiper exerts on the wet web, may vary depending upon several factors, including the purpose for the wiper, the material that the wiper is made from, the material that the wet wipe is made from and the material that the lip is made from.

The tray 3 may be made from any similar material to the housing or cover, and it may be the same material or different material from those of components. The tray may have side walls 22 and 23. The trays shown in the figures does not have bottom walls, although one may be provided if desired. The side walls may be provided with recesses 24, 25, and 26. These recess cooperate with protrusions 19, 20 and 21 on the cartridge (19 with 26, 20 with 24 and 21 with 25). In this way the cartridge is securely, yet easily removably held in the dispenser. The tray opening 15 is sized in relation to the cartridge (or the cartridge may be sized in relation to the tray opening) so that the cartridge can easily be slid into and out of the dispenser.

As is apparent from FIG. 2 the tray opening and cartridge are not symmetrically shaped, i.e., they are asymmetric. The asymmetry of the tray and cartridge results in a keyed type arrangement that allows the cartridge to be inserted in only one orientation into the dispenser. This assures that the roll of wipes will unwind from a predetermined orientation, i.e., from the bottom of the roll or the top of the roll. In the embodiment show in FIG. 2 the asymmetry is obtained by having a different number and location of protrusions and recess on opposite sides. It being recognized that any suitable means to accomplish asymmetry may be employed, such as notches, tongue and groove, the shapes of the opening and detents. Additionally, labeling or marking of the cartridge, the tray, or both can create the effect of asymmetry. Although this latter approach requires the effort of the user, where the form approach is designed to be "user proof."

The housing may further have guides 16. The guides may be movable or fixed. The guides may have raised surfaces 16*a* and lowered surfaces 16*b*. These guides may be made from the same type of material as the the housing. They may be integral with the housing. The guides and the housing may be one continuous piece of plastic. The guides may be designed to cooperate with the wiper to prevent or reduce the tendency of the wipe to skate to one side of the dispenser as the wipe is pulled out and torn off. The guides may also cooperate with the wiper to regulate and control the amount of drag. The tray may have barbs 71. An example of tray without barbs is seen at FIG. 17.

The cartridge may be made out of any suitable material, such as plastic. It is preferable that the cartridge be made from a light weight, inexpensive, disposable and recyclable material. The cartridge has side walls 17, 18, 39 and 40 and bottom wall 41. The cartridge has a lip 31 that from an opening at the top of the cartridge. The cartridge has ribs 32. The ribs may extend part way or all the way along the sides 39 and 40 and the bottom 41. The ribs 32 may cause grooves or indentations to form in the rolls, depending on the density of the roll and conditions of use. Although these grooves are not necessary to the use of the dispenser system.

The cartridge may be any shape or size provided that it fits in or cooperate with the dispenser. For example a cartridge that would be useful for application in the home would have side walls 17 and 18 that are less than 105 mm and side wall 39 and 40 that are less than 134 mm.

Instead of protrusions 19, 20 and 21, the cartridge may have recess at those location and the tray may have corresponding protrusions. Moreover, the cartridge may have ribs, like rib 32, along side walls 17 and 18.

FIG. 16 shows a dispenser in the closed condition with a tail of a wet wipe 36 protruding from gap 4 into the finger hold indentation that is formed by recess 5. In use the tail of the wet wipe would be grasped and pulled generally in the direction of arrow 35 causing the roll to unwind and the wipe to be dispensed from the dispenser. In use the wet wipe may also be subjected to forces tangential and perpendicular to the direction of arrow 35. If these forces occur the guides and the wipers help to prevent the wipe from skating to one side of the gap and bunching up or binding.

FIG. 17 is an exploded view of a dispenser, cartridge and roll of wipes 34 showing the relationship of these components.

FIG. 18 shows a roll of wipes 34 that has a tail 36 and further defines the axis of the roll as 37. Rolls useful with this dispenser or as part of a dispensing system may contain from as little as a few linear inches to more than 450 linear inches, to more than linear 600 inches to more than a thousand linear inches of wet wipes. The rolls may have a web of material that may have any number of sheets. Usually, the sheets are separated by perforations that enable the sheet to be easily tom from the web but are strong enough that they will not separate while the web is being pulled from the dispenser. An example of a roll that is particularly useful for applications in the home is one that has a diameter of about 2 inches to about 3 inches, of about less than 5½ inches, and preferably has a diameter of about 3 inches and more preferably of about 2.875 inches. This roll has from about 400 linear inches of wipes to about 1000 linear inches of wipes. Each sheet length may be from about 3½ to 6½ inches and preferably are about 4.5 inches. These roll further have a density of from about 0.5 g/cc to about 1 g/cc and preferably about 0.62 g/cc. A particular example of roll may be one having a diameter of about 2.33 inches and containing about 450 linear inches of wipe. Another particular example of a roll may be one having a diameter of about 2.875 inches and containing 450 linear inches of wipes.

The preferred form of wet wipes for use with the dispenser system is a sold coreless roll as shown in FIG. 18. It is to be understood, however, that cored rolls, hollow coreless rolls, and stacks of sheets may also be used in the dispenser system.

Table I sets out types of wet sheets and their properties.

TABLE I

| | Wet Wipe Example 1 | | Wet Wipe Example 2 | |
|---|---|---|---|---|
| | Run Average | Run STDeV | Run Average | Run STDev |
| Basis | 60 gsm | | 60 gsm | |
| Solution | commercial | | 4% salt solution | |
| Solution Add on level | 175% | | 195% | |
| Basesheet | 4.25" width | | 4.25" width | |
| Converting perforation | 0.11" | | 0.7" | |
| Wet tensiles | | | | |
| MD Tensile (g/in) | 379.847 | 25.852 | 320.943 | 30.477 |
| MD Stretch (% Elongation) | 22.700 | 1.386 | 28.254 | 1.583 |
| TEA (Ft-Lb/Sq. In) | 0.957 | 0.057 | 1.022 | 0.073 |
| CD Tensile (g/in) | 328.772 | 28.283 | 287.417 | 29.034 |
| CD Stretch (% Elongation) | 27.650 | 1817 | 34.146 | 3.474 |
| TEA (Ft-Lb/Sq. In) | 0.928 | 0.089 | 0.965 | 0.131 |
| Detach (g-in) | 375.863 | 20.716 | 426.789 | 33.789 |
| % strain @ pk load | 8.341 | 0.456 | 10.975 | 1.077 |
| Dry Basis Weight (gsm) | 57.052 | 2.404 | 65.978 | 3.651 |
| Thickness (mm) | 0.562 | 0.017 | 0.474 | 0.013 |
| Sheet Count | 98.917 | 0.669 | 99.077 | 1.115 |

Table II contains additional data reflecting the properties of wet wipes. This table shows the effects on changing base sheet and solution variable has on the physical properties of the wipes.

TABLE II

| | Basesheet Variables | | | |
|---|---|---|---|---|
| | 100% pulp/ 65 gsm 22% binder/1.1 mm dry bulk | 100% pulp/ 60 gsm 20% binder/.76 mm dry bulk | 100% pulp/ 55 gsm 20 binder/.76 mm dry bulk | 15% PET/ 55 gsm 20% binder/.84 mm dry bulk |
| solutions | | | | |
| | Example 3 | Example 4 | Example 5 | Example 6 |
| 0.5% silicone 0.25% lanolin | MDWT = 500 g/l" CDWT = 445 g/l" wet bulk = 0.46 mm peel force = 167 g. | MDWT = 452 g/l" CDWT = 403 g/l" wet bulk = 0.40 mm peel force = 131 g. | MDWT = 383 g/l" CDWT = 334 g/l" wet bulk = 0.39 mm peel force = 106 g. | MDWT = 391 g/l" CDWT = 310 g/l" wet bulk = 0.41 mm peel force = |
| | Example 7 | | Example 8 | Example 9 |
| 1.0% silicone 0.25% lanolin | MDWT = 473 g/l" CDWT = 455 g/l" wet bulk = 0.45 mm peel force = 170 g. | | MDWT = 401 g/l" CDWT = 348 g/l" wet bulk = 0.40 mm peel force = 120 g. | MDWT = 416 g/l" CDWT = 350 g/l" wet bulk = 0.39 mm peel force = 115 g. |
| | Example 10 | | | |
| 1.0% silicone 0.0% lanolin | MDWT = 528 g/l" CDWT = 462 g/l" wet bulk = 0.44 mm peel force = 162 g. | | | |

Table III sets out the physical properties of rolls of wet wipes and Table IV sets out the theoretical physical properties of rolls of wet wipes.

TABLE III

| Coreless Roll Measurements and Calculations Actual Data From Rolls Produced | | | | | |
|---|---|---|---|---|---|
| | | | Initial Sheet Length | 5 | inches |
| | | | lnitial Sheet Width | 4.125 | inches |
| | | | Number of Sheets in Roll | 90 | |
| | | | Dry Basesheet Basis Weight | 65 | gsm |
| | | | Target Solution Add-on | 225 | % |
| | | | Caicuiated Roll Weight | 253 | grams |
| | | Unwound | Assumed Wet Thickness Prior to Winding Calculated | 0.48 Calculated | mm |
| Roll Number | Measured Diameter (inches) | Wet Thicknesss (mm) | Roll Density (g/cm^3) | Effective Thickness mm | Compression Factor (%) |
| 1 | 2.77 | NA | 0.62136 | 0.33998 | 71% |
| 2 | 2.83 | 0.41 | 0.59530 | 0.35487 | 74% |
| 3 | 2.86 | NA | 0.58287 | 0.36243 | 76% |

TABLE III-continued

| | | | | | |
|---|---|---|---|---|---|
| 4 | 2.90 | NA | 0.56690 | 0.37264 | 78% |
| 5 | 2.96 | 0.478 | 0.54415 | 0.38822 | 81% |
| 6 | 2.86 | NA | 0.58287 | 0.36243 | 76% |
| 7 | 2.98 | NA | 0.53688 | 0.39348 | 82% |
| 8 | 2.88 | NA | 0.57481 | 0.36752 | 77% |
| 9 | 2.94 | NA | 0.55158 | 0.38299 | 80% |
| 10 | 2.86 | 0.448 | 0.58287 | 0.36243 | 76% |
| 11 | 2.86 | NA | 0.58287 | 0.36243 | 76% |
| 12 | 2.84 | NA | o.59111 | 0.35738 | 74% |
| 13 | 3.00 | NA | 0.52974 | 0.39878 | 83% |
| 14 | 2.86 | NA | 0.58287 | 0.36243 | 76% |
| 15 | 2.86 | NA | 0.58287 | 0.36243 | 76% |
| Compression Factor | | | | Wet Thickness Prior to Winding Eftective Thickness (Wound) | |

TABLE IV

Coreless Roll Calculations Theoretical Roll Density Possibilities

| | | |
|---|---|---|
| Initial Sheet Length | 4.5 | inches |
| Initial Sheet Width | 4.125 | inches |
| Number of Sheets in Roll | 100 | |
| Total Roll Length | 37.5 | feet |

| Dry Basesheet Weight (gsm) | Solution Add-on (%) | Calculated Roll Weight (grams) | Assumed Pre-wound Wet Thickness (mm) | Assumed Compression Factor (%) | Calculated Roll Diameter (inches) | Calculated Roll Density (g/cm^3) | Footnotes |
|---|---|---|---|---|---|---|---|
| 65 | 225 | 253 | 0.48 | 1.30000 | 3.75 | 0.33854167 | (1) |
| 65 | 225 | 253 | 0.48 | 1.15000 | 3.53 | 0.38269928 | |
| 65 | 225 | 253 | 0.48 | 1.00000 | 3.29 | 0.44010417 | (2) |
| 65 | 225 | 253 | 0.48 | 0.90000 | 3.12 | 0.48900463 | |
| 65 | 225 | 253 | 0.48 | 0.80000 | 2.94 | 0.55013021 | |
| 65 | 225 | 253 | 0.48 | 0.71000 | 2.77 | 0.61986502 | (3) |
| 65 | 225 | 253 | 0.48 | 0.60000 | 2.55 | 0.73350694 | |
| 65 | 225 | 253 | 0.48 | 0.50000 | 2.33 | 0.88020833 | (4) |
| 65 | 225 | 253 | 0.48 | 0.44000 | 2.18 | 1.00023674 | |
| 65 | 225 | 253 | 0.48 | 0.40500 | 2.09 | 1.08667695 | (5) |
| 65 | 300 | 311 | 0.48 | 1.30000 | 3.75 | 0.41666667 | |
| 65 | 300 | 311 | 0.48 | 1.15000 | 3.53 | 0.47101449 | |
| 65 | 300 | 311 | 0.48 | 1.00000 | 3.29 | 0.54166667 | |
| 65 | 300 | 311 | 0.48 | 0.90000 | 3.12 | 0.60185185 | |
| 65 | 300 | 311 | 0.48 | 0.80000 | 2.94 | 0.67708333 | |
| 65 | 300 | 311 | 0.48 | 0.70000 | 2.75 | 0.77380952 | |
| 65 | 300 | 311 | 0.48 | 0.60000 | 2.55 | 0.90277778 | |
| 65 | 300 | 311 | 0.48 | 0.50000 | 2.33 | 1.08333333 | |
| 50 | 225 | 195 | 0.48 | 1.30000 | 3.75 | 0.26041667 | |
| 50 | 225 | 195 | 0.48 | 1.15000 | 3.53 | 0.29438406 | |
| 50 | 225 | 195 | 0.48 | 1.00000 | 3.29 | 0.33854167 | |
| 50 | 225 | 195 | 0.48 | 0.80000 | 2.94 | 0.42317708 | |
| 50 | 225 | 195 | 0.48 | 0.60000 | 2.55 | 0.56423611 | |
| 50 | 225 | 195 | 0.48 | 0.40000 | 2.08 | 0.84635417 | |
| 50 | 225 | 195 | 0.48 | 0.31300 | 1.84 | 1.08160277 | |
| 50 | 150 | 150 | 0.48 | 1.30000 | 3.75 | 0.20032051 | (6) |
| 50 | 150 | 150 | 0.48 | 1.00000 | 3.29 | 0.26041667 | |
| 50 | 150 | 150 | 0.48 | 0.80000 | 2.94 | 0.32552083 | |
| 50 | 150 | 150 | 0.48 | 0.60000 | 2.55 | 0.43402778 | |
| 50 | 150 | 150 | 0.48 | 0.40000 | 2.08 | 0.65104167 | |

TABLE IV-continued

| | | | | Coreless Roll Calculations Theoretical Roll Density Possibilities | | |
|---|---|---|---|---|---|---|
| 50 | 150 | 150 | 0.48 | 0.30000 | 1.80 | 0.86805556 |
| 50 | 150 | 150 | 0.48 | 0.24000 | 1.61 | 1.08506944 |

Footnotes
(1) A very loose roll, no compression, lots of air spaces, giving an overall low density
(2) A roll that theoretically has no compression; this density and volume for roll vs. unrolled would be equal
(3) A roll that has been produced at OG, with this compression and roll density
(4) Estimate of maximum compression achievable before product failure from in-wound tension exceeding strength of sheets or perforations
(5) Physical limitation of the maximum density achievable based on incompressibility of water
(6) Low end density achieved by a loose roll, low dry basis weight and low % Add-on The peel force was measured with an MTS Sintech 1/G test machine with TestWorks 3.10 software. All testing as done in a conditioned laboratory under Tappi Standard conditions. A 4.5-inch wide clamp with rubber surfaces gripped the tail of a roll, with the roll position directly underneath the clamp such the tail would remain vertical as it was unwound from the roll if there were no peel force causing the web to wrap a portion of the roll and deflect from the vertical. The damp was attached to the crosshead, which pulled the tissue web upward at a speed of 100 cm/minute. Peel force was measured by a 50 N load cell. The average load to pull 18 sheets away from the roll was recorded by averaging two runs in which 4 sheets each were separated and two runs in which 5 sheets each were separated. Only the first 18 sheets from the roll were used in the measurement.

FIG. 19 shows the roll 34 as it is placed in a cartridge in a dispenser. The spiral line 38 is intended to represent the manner in which the roll is wound and depicts in that configuration a roll that is being unwound from the bottom. That figure further shows the relationship of the wiper 10 to the wet web. FIG. 20 shows the roll 24 in cartridge 11, with spiral line 38 indicating the wind of the roll. This figure shows the relationship of the roll and the ribs 32. As can be seen from this figure the roll is lifted off of the side and back walls of the cartridge by rib 32. Thus, the amount of surface are of the roll that is in contact with the cartridge is reduced. This in turn reduces the drag that the roll experiences from friction with the cartridge when the roll is turned.

FIG. 21 shows a portion of a cartridge 11, the lip 31 of the cartridge, and the side walls 39 and 40. The angle that the cartridge is position at has an effect on how well the dispenser will perform. The angle will have a tendency to add or reduce the drag associated with pulling the wipe out. It will have an effect on the amount of wicking or drying through wicking that may take place in the wet wipe. It may also have an effect on how the roll acts as it is unwound, becoming smaller and smaller in the cartridge. The angle of the cartridge can be measured by the angle that the lip 31 forms with a true vertical axis, shown as 42. For a dispenser system as shown in FIGS. 1–19, the angle 43 that the lip 31 has with a true vertical axis 42 should be from about 10 degrees to about 80 degrees, from about 20 degrees to about 70 degrees, at least greater than 20 degrees, at least smaller than 60 degrees, and preferably about 30 degrees.

Further the angle may be selected such that it balances the forces between the peel forces associated with unrolling the roll and the weight of the roll forcing it down against the ribs. Thus the wipe can be unrolled without having excessive movement of the roll within the cartridge, which in turn overcomes the tendency of the roll to translate toward the gap and bind or jam the dispenser. Additionally, the selection of the angle may play a role in reducing the drying of the wet wipe. As the angle 43 is increased the difference between the height of the top of the roll and the tail is decreased. Thus, decreasing any siphoning driving force.

FIGS. 22 through 25 show various views of an example of a cover. In this example the cover 7 has cover mounts 29, a recess 5 for forming part of a finger hold indentation, an inside rim 33, which has a bottom inside rim section 45 and side inside rim sections 46 (of which only one can be seen in FIG. 24), leg sections 72, and posts 44. In this example the posts are used to connect the wiper to the cover.

FIGS. 26 through 28 show an example of a tray 3*a*. In this example the tray has an opening 15*a* with 3 recesses on both sides. The tray has guides that are rollers 47.

In a further example of the tray, the tray is fixed to the housing. This may be accomplished by having the housing and tray being made out of a single piece of material of having the housing and tray joined together by a permanent bonding means, such as welding, heat bonding or gluing. In yet a further example the tray may be attached to the housing so that is can not rotate with respect to the housing, yet still may be removable.

FIG. 29 shows the rollers 47 used in the tray 3*a* shown FIGS. 26–28. The rollers have raised surfaces 67 and lowered surfaces 67. The raised and lowered surfaces of the rollers as well as any guide may also be a ridge or a rim. As the raised or lowered surfaces become narrower, i.e., become sharper, care must be taken not to cut the wet web.

Wipers may be made out of any flexible material, such as thermoplastic elastomers, foam, sponge, plastic, or rubber having a shore A durometer ranging about 0 to 80, from about 15 to about 70 and preferably from about 30 to about 60. It is further preferred that the wipers be made from a material that will form a good moisture and contamination barrier. Examples of preferred types of material are SANTOPRENE®, silicone, or styrene ethylene/butylenes styrene (SEBS). The wipers are designed to function with the guides and the tray and to a limited extent the lip of the cartridge. Depending on the placement of the wiper, it could have greater or lesser interaction with these components of the dispensing system. The gap between the end of the wiper and the tray may be varied depending upon the thickness of the wet wipes and how much drag is need for the dispensing system to function as desired. The wiper can help to hold the tail of the wipe in place and thus keep the tail from falling back through the gap and into the cartridge. The wiper has a Gurley stiffness test (D 6125–97) from a range of 100–8000 mg, preferably 200–6000 mg, and more preferably 400–3000 mg. The force applied to the wipe by the wiper when pulling the wipe from the dispenser should not be greater than the tensile strength of the wipe that is not perforated and not greater than the perforation tensile strength of a perforate wipe.

FIGS. 32 through 36 show an example of a wiper. In this example the wiper comprises a chassis 48, and a blade 50 that has fingers 49. In this example the fingers are designed to cooperate with the lowered surfaces 16*b* of the guides on the housing. In this example the blade is made of SANTOPRENE® and the chassis is made of polypropylene.

FIGS. 38 through 39 show an example of a wiper. In this example the wipe is formed of a single piece (see FIG. 38) of material that is folded over to from the wiper (see FIG. 39). The wiper has raised portions 51 that reduce the amount of surface area of the wiper that contacts the sheet and raised areas 53 and lowered areas 52 that cooperate with the raised and lowered areas of the guides.

FIGS. 40 through 41 show an example of a roller bar for toilet tissue. This example comprises a first roller housing 53, a second roller housing 52 and a spring 54.

Figure 44:
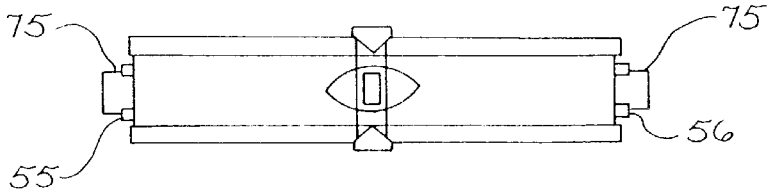
Figure 45:
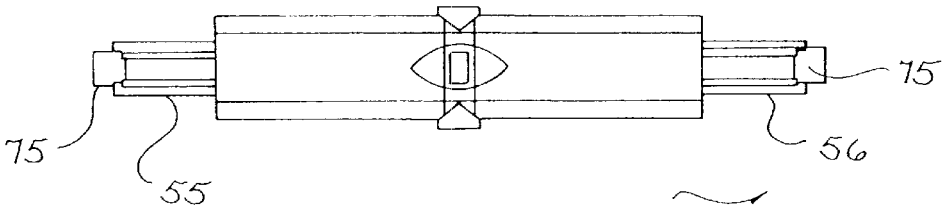
Figure 43:
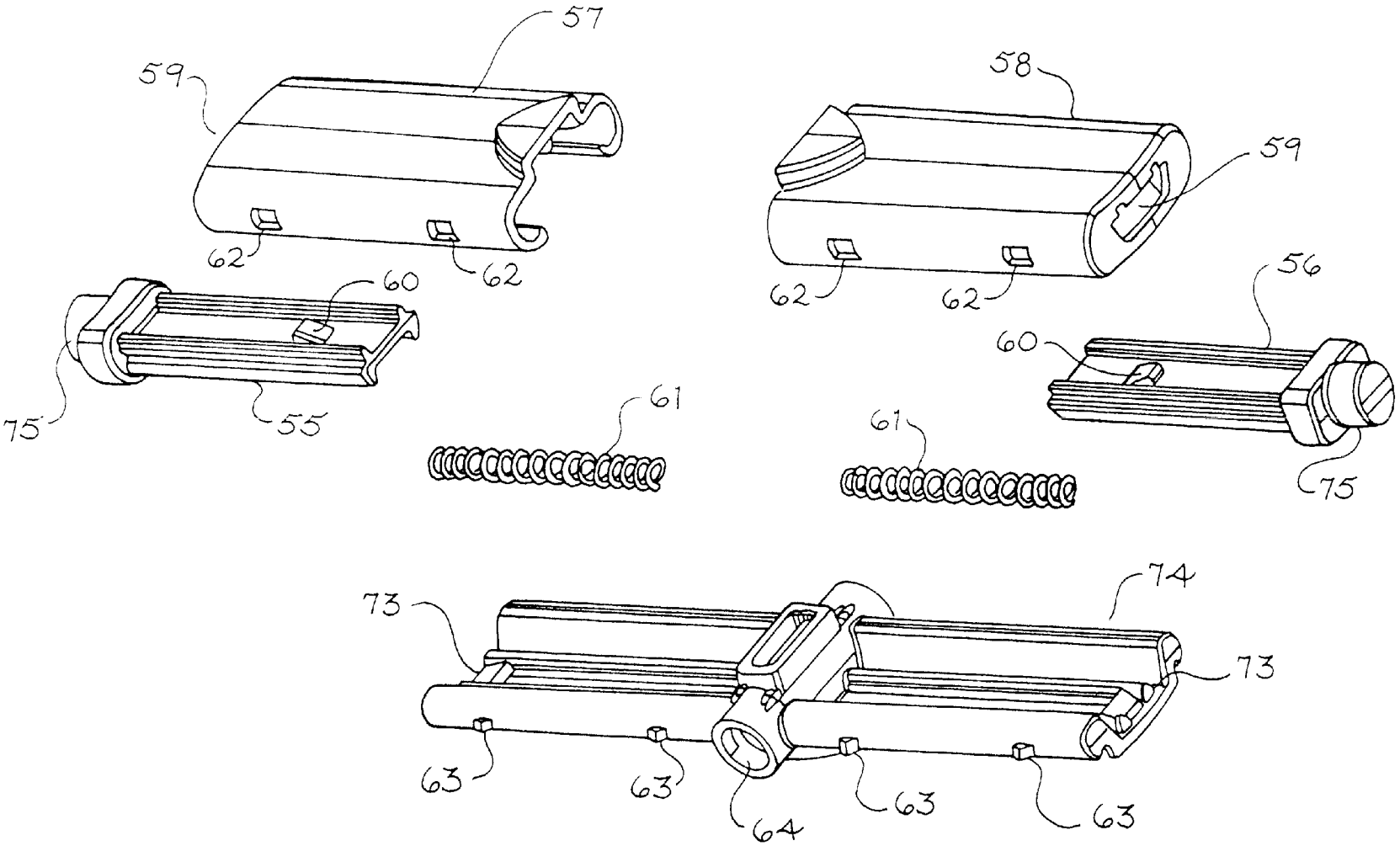

FIGS. 42 through 45 show an example of a mounting assembly. This mounting assembly comprises slide arms 55 and 56, housings 57 and 58, end openings 59, and springs 61. The slide arms have stops 60 that cooperate with stops 73 to limit the maximum longitudinal extension of the slide arms. The mounting assembly has a third housing 74 that has tabs 63 that cooperate with openings 62 to secure the housings 57 and 58 to housing 74. Housing 74 further has a threaded passage 64 for receipt of a screw. FIG. 44 shows the mounting assembly with the slide arms in a retracted position 55, while FIG. 45 shows the mounting assembly with the slide arms in an extended position 55.

The assembly is held in place by having the ends out the side arms positioned in holes in the object that the dispenser is to be attached for, for example the holes in a toilet paper dispenser mounted into a wall. The springs keep the slide arms extended and thus hold them in the holes. A screw is then inserted through the dispenser and the passage 64 and tightened down, forcing the end engagement surfaces 75 against the wall of the holes in the toilet tissue dispenser.

The mounting assembly should be made out of material that is strong enough to withstand the forces that are placed on it to hold the dispenser in place. The should have enough strength to withstand the forces that the screw will place on the treaded passage. Examples of materials that may provide these features and be used to make the mounting assembly are 15% or more glass filled Pbt, ABS or any material having similar strength properties.

FIGS. 46 to 50 show an example of a screw 9 that cooperates with a mounting device, such as the example shown in FIGS. 42–45. The Screw should be made of material that meets the same strength requirements as set out for the mounting assembly. In this example the screw has a thread design that requires 6 turns to move it 1 inch. Standard ACME conventional screw threads require 23 turns to move it 1 inch. This thread design provides greater ease for the user to attach the dispenser because it requires less turns of the screw to do so. In this example the screw additionally has a large head, with a grove 65 and grips 66. The grove can fit a coin or screw driver.

Alternative mountings may also be employed. These mountings may be fixed or removable. They may include by way of example such fastening systems as cable ties, wing nuts, anchor bolts, click and grooves and snap and lock mechanisms.

FIGS. 51–53 show an example of a cartridge. In this example the cartridge has protrusions 69 on its side walls.

FIG. 54 shows an example of a package of cartridges. In use this package would be filled with rolls of wet wipes, one for each cartridge. The cartridges would than be sealed, by placing a totally or partially removable cover over the lips 31. The seal is preferably moisture and bacterial resistant. The consumer would then purchase the package and remove a cartridge, open the dispenser and place the cartridge in the dispenser. The top of the cartridge can be removed either before placing the cartridge in the dispenser or after its inserted in the dispenser. The end of the roll of wet wipes is then pulled out and over the tray and guides and the cover is then closed. Thus, providing an efficient system for dispensing wet wipes.

We claim:

1. A wet wipes dispenser comprising:

a housing;

a tray, the tray having sides forming an opening;

a cartridge having a roll of wet wipes;

the cartridge having a shape that provides for insertion into the tray opening in only one orientation that results in the roll being unwound from a bottom of the roll.

2. The wet wipes dispenser of claim 1, wherein the angle of the cartridge is from about 20 degree to about 80 degrees from vertical, when the dispenser is in its intended orientation.

3. The dispenser of claim 1 wherein the tray is an integral part of the housing.

4. The dispenser of claim 1 further comprising a cover;

the cover providing a moisture barrier around the roll of wet wipes once the cartridge is inserted into the tray and the cover is closed.

5. A cartridge for wet wipes:

the cartridge having a length and a width; the length being no greater than 135 mm and the width being no greater than 106 mm; the cartridge further comprising a roll of wet wipes having a density of from about 0.5 g/cc to about 0.99 g/cc.

6. The cartridge of claim 5 further having an asymmetric shape.

7. The cartridge of claim 5 further comprising ribs.

* * * * *